US008334826B2

(12) United States Patent
Min et al.

(10) Patent No.: US 8,334,826 B2
(45) Date of Patent: Dec. 18, 2012

(54) DISPLAY DEVICE AND DRIVING METHOD THEREOF

(75) Inventors: Ung-Gyu Min, Namyangju (KR); Oh-Kyong Kwon, Seoul (KR)

(73) Assignees: Samsung Display Co., Ltd., Yongin (KR); Industry-University Cooperation Foundation Hanyang University, Seoul (KR)

( * ) Notice: Subject to any disclaimer, the term of this patent is extended or adjusted under 35 U.S.C. 154(b) by 819 days.

(21) Appl. No.: 12/506,728

(22) Filed: Jul. 21, 2009

(65) Prior Publication Data

US 2010/0188390 A1 Jul. 29, 2010

(30) Foreign Application Priority Data

Jan. 23, 2009 (KR) ..... 10-2009-0006324

(51) Int. Cl.
*G09G 3/32* (2006.01)

(52) U.S. Cl. ..... 345/82; 345/76; 345/204; 345/212; 315/169.3

(58) Field of Classification Search ..... 345/39, 345/46, 76, 77, 82, 204, 212; 315/169.3
See application file for complete search history.

(56) References Cited

U.S. PATENT DOCUMENTS

2006/0290613 A1* 12/2006 Hong et al. ..... 345/76
2007/0018917 A1* 1/2007 Miyazawa ..... 345/76

* cited by examiner

*Primary Examiner* — Lun-Yi Lao
*Assistant Examiner* — Insa Sadio
(74) *Attorney, Agent, or Firm* — H.C. Park & Associates, PLC

(57) ABSTRACT

The present invention relates to a pixel and a data driver, and a driving method thereof to measure degradation of an organic light emitting element and a threshold voltage and mobility of a driving transistor in an organic light emitting device, wherein the degradation of the organic light emitting element and the threshold voltage and the mobility of the driving transistor are measured in a turn-on interval or a frame interval of the display device to amend the data voltage applied to the pixel, and thereby images of improved and uniform quality may be displayed.

20 Claims, 20 Drawing Sheets

DISPLAY DEVICE AND DRIVING METHOD THEREOF

CROSS REFERENCE TO RELATED APPLICATION

This application claims priority from and the benefit of Korean Patent Application No. 10-2009-0006324, filed on Jan. 23, 2009, which is hereby incorporated by reference for all purposes as if fully set forth herein.

BACKGROUND OF THE INVENTION

1. Field of the Invention

The present invention relates to a display device and a driving method thereof, and particularly to an organic light emitting device and a driving method thereof.

2. Discussion of the Background

A hole-type flat panel display such as an organic light emitting device displays a fixed picture for a predetermined time period, for example for a frame, regardless of whether it is a still picture or a motion picture. As an example, when some continuously moving object is displayed, the object stays at a specific position for a frame and then stays at a next position to which the object has moved after a time period of a frame in the next frame, i.e., movement of the object is discretely displayed. Since an afterimage is maintained within one frame, the motion of the object is displayed as continuous when it is displayed through the above-noted method.

However, when a user views the moving object on the screen, since the user's eyes continue to move as the object moves, the screen display appears blurred by the mismatched display with the discrete displaying method by the display device. For example, assuming that the display device displays that an object stays at the position A in the first frame and it stays at the position B in the second frame, the user's eyes move along the object's expected moving path from the position A to the position B in the first frame. However, the object is not actually displayed at intermediate positions other than the positions A and B.

Resultantly, the object appears blurred since the luminance sensed by the user during the first frame is acquired by integrating the luminance of pixels on the path between the positions A and B, that is, the average of the luminance of the object and the luminance of the background.

Since the blurring degree of the hole-type display device is in proportion to the time for the display device to maintain display, an impulse drive method for displaying the image for a predetermined time within one frame and displaying black for the rest of the time has been proposed. In this method, since the time for displaying the image is reduced to decrease the luminance, a method for increasing the luminance for the time of displaying or displaying the intermediate luminance with the neighboring frame other than black has been proposed. However, this method increases power consumption and increases drive complexity.

The pixel of the organic light emitting device includes an organic light emitting element and a thin film transistor (TFT) for driving the organic light emitting element, and when they are operated for a long time, the threshold voltage is varied so that the expected luminance may not be output, and when the characteristic of a semiconductor included in the thin film transistor is not uniform in the display device, luminance deviation between the pixels may occur.

SUMMARY OF THE INVENTION

Exemplary embodiments of the present invention provide a device to measure the threshold voltage and the mobility of the driving transistor and the degradation of the organic light emitting element in the organic light emitting device, and to amend the data by using the measurements for providing constant luminance.

Additional features of the invention will be set forth in the description which follows, and in part will be apparent from the description, or may be learned by practice of the invention.

An exemplary embodiment of the present invention discloses a display device including a data driver, a plurality of data lines and a plurality of sensing lines connected to the data driver. A pixel is connected to each data line and sensing line, and displays an image. The pixel includes a light-emitting element including a first terminal and a second terminal, a driving transistor to output a driving current to drive the light-emitting element, and including a control terminal, an input terminal and an output terminal. A first switching transistor controlled by a first scanning signal, is connected between the respective data line and the control terminal of the driving transistor. A second switching transistor controlled by a second scanning signal, is connected between the respective sensing line and the output terminal of the driving transistor. A third switching transistor controlled by a third scanning signal, is connected between the output terminal of the driving transistor and the first terminal of the light-emitting element. A fourth switching transistor controlled by the fourth scanning signal, is connected between the control terminal of the driving transistor and the respective sensing line, and a capacitor is connected between the control terminal of the driving transistor and a driving voltage terminal.

An exemplary embodiment of the present invention also discloses a method for driving a display device. The display device has a display panel including a pixel. The pixel includes a light-emitting element including a first terminal and a second terminal, a driving transistor to output a driving current to drive the light-emitting element and including a control terminal, an input terminal, and an output terminal. A first switching transistor controlled by a first scanning signal is connected between a data line and the control terminal of the driving transistor, a second switching transistor controlled by a second scanning signal is connected between a sensing line and the output terminal of the driving transistor, a third switching transistor controlled by a third scanning signal is connected between the output terminal of the driving transistor and the first terminal of the light-emitting element, and a fourth switching transistor controlled by a fourth scanning signal is connected between the control terminal of the driving transistor and a sensing line. Also, a capacitor is connected between the control terminal of the driving transistor and a terminal of a driving voltage, a plurality of data lines and a plurality of sensing lines are connected to the pixel, and a data driver is connected to the data lines and the sensing lines. The method includes executing at least one of determining a threshold voltage of the driving transistor, determining a mobility of the driving transistor, and determining a degradation of the light-emitting element, and amending and converting an input data into a data voltage based on the determination result to apply the data voltage to the pixel according to the respective data line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
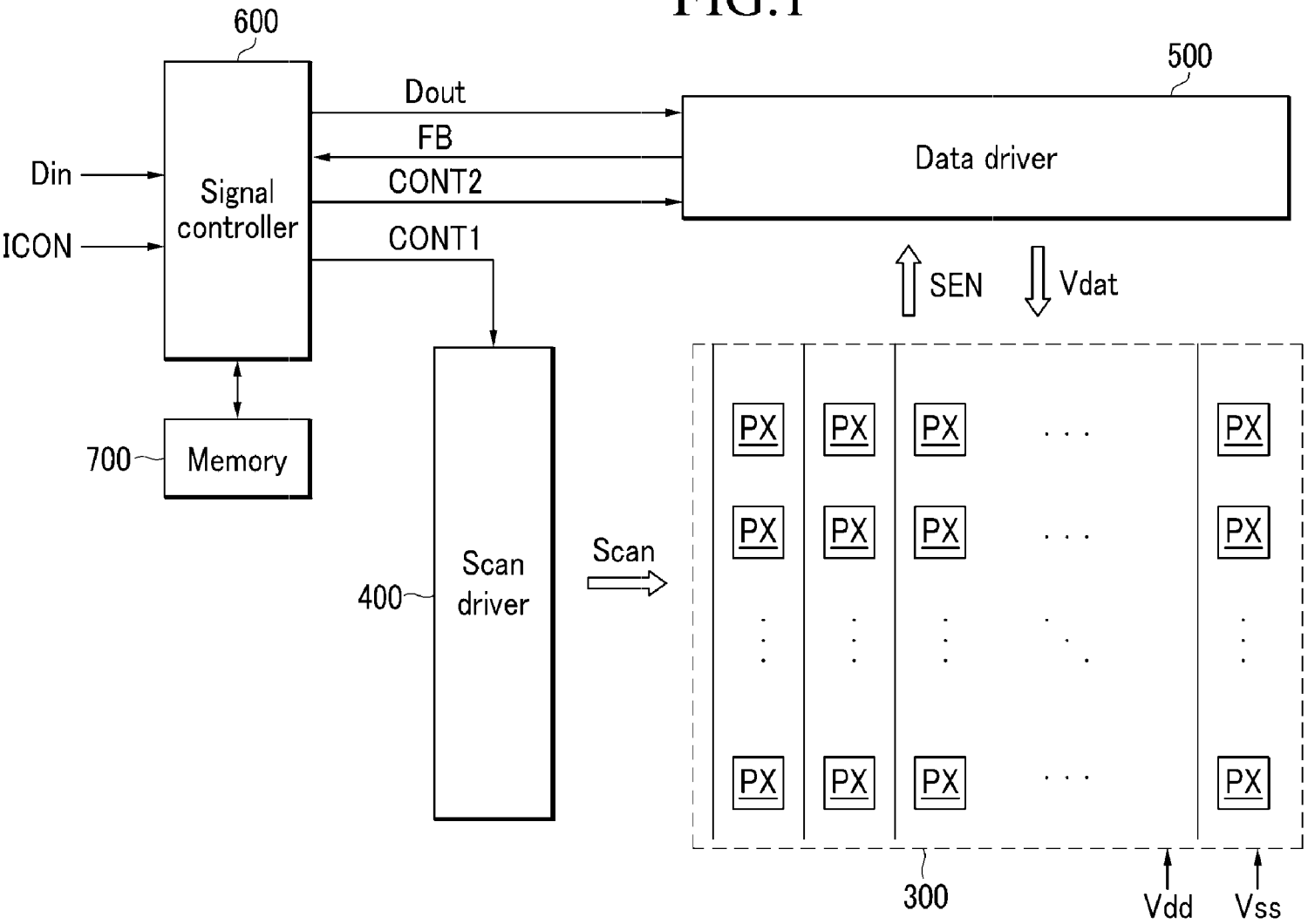
FIG. 1 shows a block diagram of an organic light emitting device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

An organic light emitting device according to an exemplary embodiment of the present invention will now be described with reference to FIG. 1 and FIG. 2.

Figure 2:
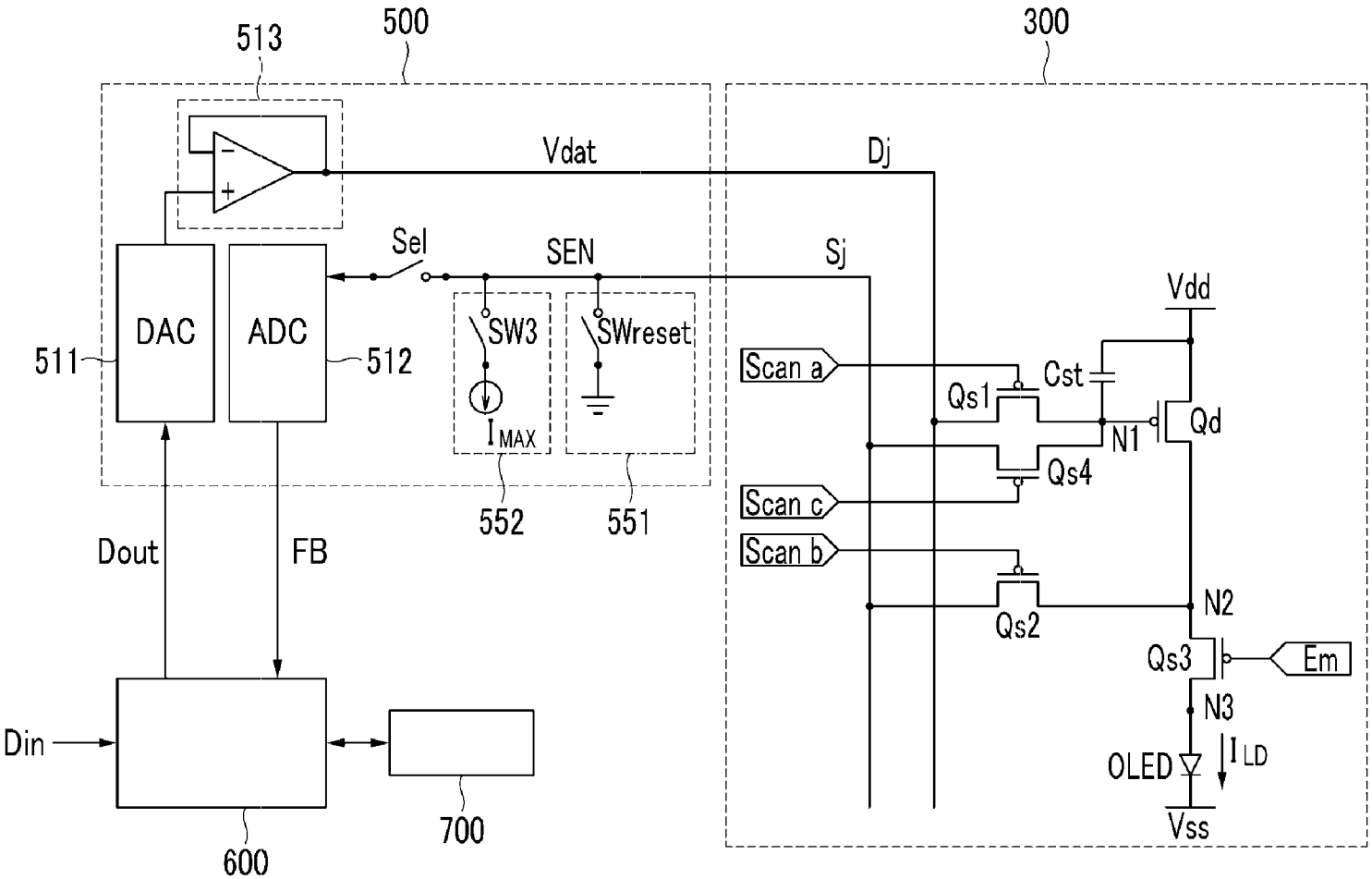
FIG. 2 shows an equivalent circuit diagram of a pixel in an organic light emitting device according to an exemplary embodiment of the present invention, along with a data driver, a signal controller, and a memory.

FIG. 1 shows a block diagram of an organic light emitting device according to an exemplary embodiment of the present invention, and FIG. 2 shows an equivalent circuit diagram of a pixel in an organic light emitting device according to an exemplary embodiment of the present invention, along with a data driver, a signal controller, and a memory.

Referring to FIG. 1, the organic light emitting device includes a display panel 300, a scan driver 400, a data driver 500, a signal controller 600, and a memory 700.

The display panel 300 includes a plurality of signal lines (not shown), a plurality of voltage lines (not shown), and a plurality of pixels PX connected thereto and substantially arranged as a matrix.

The signal lines include a plurality of scanning signal lines to transmit scanning signals, a plurality of sensing lines to transmit sensing data signals SEN, and a plurality of data lines to transmit data signals Vdat. The scanning signal lines G1-Gn are extended in approximately a row direction and are substantially parallel to each other, and the sensing lines and the data lines are extended in approximately a column direction and are substantially parallel to each other.

The voltage lines include a driving voltage line (not shown) to transmit a driving voltage Vdd.

As shown in FIG. 2, the pixel PX includes an organic light emitting element OLED, a driving transistor Qd, a capacitor Cst, a first switching transistor Qs1, a second switching transistor Qs2, a third switching transistor Qs3 and a fourth switching transistor Qs4.

The driving transistor Qd has an output terminal, an input terminal, and a control terminal. The control terminal of the driving transistor Qd is connected at a node N1 to the capacitor Cst, the first switching transistor Qs1 and the fourth switching transistor Qs4. The input terminal of the driving transistor Qd is connected to the driving voltage Vdd, and the output terminal thereof is connected at a node N2 to the second switching transistor Qs2 and the third switching transistor Qs3.

A first terminal of the capacitor Cst is connected at the node N1 to the driving transistor Qd, and a second terminal thereof is connected to the driving voltage Vdd.

The first switching transistor Qs1 is operated in response to a first scanning signal scan a, the second switching transistor Qs2 is operated in response to a second scanning signal scan b, the third switching transistor Qs3 is operated in response to a third scanning signal Em, and the fourth switching transistor Qs4 is operated in response to a fourth scanning signal scan c. The first switching transistor Qs1 is connected between the data line Dj and the node N1, the second switching transistor Qs2 is connected between the sensing line Sj and the node N2, the third switching transistor Qs3 is connected between the anode (i.e., node N3) of the organic light emitting element OLED and the node N2, and the fourth switching transistor Qs4 is connected between the sensing line Sj and the node N1.

In the present exemplary embodiment, the driving transistor Qd, and the first switching transistor Qs1, the second switching transistor Qs2, the third switching transistor Qs3, and the fourth switching transistor Qs4 are p-channel electric field effect transistors. An example of the electric field effect transistor can be a thin film transistor (TFT), and it may include polysilicon or amorphous silicon. A low voltage Von may turn on the first switching transistor Qs1, the second switching transistor Qs2, the third switching transistor Qs3, and the fourth switching transistor Qs4, and a high voltage Voff may turn off the first switching transistor Qs1, the second switching transistor Qs2, the third switching transistor Qs3, and the fourth switching transistor Qs4.

The anode (i.e., node N3) of the organic light emitting element OLED is connected to the third switching transistor Qs3, and a cathode thereof is connected to a common voltage Vss. The organic light emitting element OLED displays images by emitting light and varying the intensity thereof according to the current $I_{LD}$ supplied by the driving transistor Qd through the third switching transistor Qs3, and the current $I_{LD}$ depends on the voltage between the control terminal and the input terminal of the driving transistor Qd.

Referring to FIG. 2, the data driver 500 includes constituent elements as follows.

Basically, a digital-to-analog converter 511, an analog-to-digital converter 512, and an OP amplifier 513 are included. The digital-to-analog converter 511 receives digital output image signals Dout of the display pixels PX for each row to convert them into analog voltages and to apply the converted analog voltages to the OP amplifier 513 such that the OP amplifier 513 amplifies the converted analog voltages into non-inversion signals and applies them to the data lines $D_1$-$D_m$ as analog data voltages Vdat. On the other hand, the analog-to-digital converter 512 receives sensing data signals SEN from each display pixel PX through the sensing lines Sj and converts and outputs them as digital values (i.e., digital sensing data signal FB).

Further, the data driver 500 additionally includes a switch Se1 to control the sensing line Sj and the analog-to-digital converter 512, a threshold voltage sensor 551 to sense a threshold voltage, and a mobility sensor 552 to sense a mobility. The threshold voltage sensor 551 according to an exemplary embodiment of the present invention includes a ground terminal and a reset switch SWreset to control the switching, and the mobility sensor 552 includes a switch SW3 to control the connection with a current source discharging a maximum current $I_{MAX}$. In the data driver 500, degradation of the organic light emitting element OLED is detected and the illustrated exemplary embodiment of the data driver 500 shown in FIG. 2 may detect degradation without additional constituent elements.

The signal controller 600 controls the operations of the scan driver 400 and the data driver 500, and receives the digital sensing data signal FB to amend the input image signal Din according to characteristics (threshold voltage and mobility) of the driving transistor Qd and a characteristic (a degree of the degradation) of the organic light emitting element OLED and to output the output image signal Dout. Here, the signal controller 600 amends the input image signals Din by using characteristic data and a lookup table stored in the memory 700, and the memory 700 is formed outside of the signal controller 600, however it may be formed inside the signal controller 600.

The memory 700 stores the data (the data for the threshold voltage, the mobility and the degradation) detected in the pixels PX, and the lookup table corresponding to the detected data.

Each of the drivers 400, 500, and 600 may be directly mounted on the liquid crystal panel assembly 300 in the form of at least one IC chip, may be mounted on a flexible printed circuit film (not shown) and then mounted on the liquid crystal panel assembly 300 in the form of a tape carrier package (TCP), or may be mounted on a separate printed circuit board (not shown). Alternatively, the drivers 400; 500, and 600 may be integrated with the liquid crystal panel assembly 300 together with, for example, the signal lines and the transistors Qs1-Qs4 and Qd. The drivers 400, 500, and 600 may be integrated into a single chip. In this case, at least one of the drivers or at least one circuit forming the drivers may be arranged outside the single chip.

Next, a method for measuring a threshold voltage (Vth) and a mobility (μ) of a driving transistor Qd, and a degradation of an organic light emitting element OLED will be described in the organic light emitting device according to an exemplary embodiment of the present invention.

Firstly, a method for measuring a threshold voltage Vth of the driving transistor Qd according to an exemplary embodiment of the present invention will be described with reference to FIG. 3.

Figure 3:
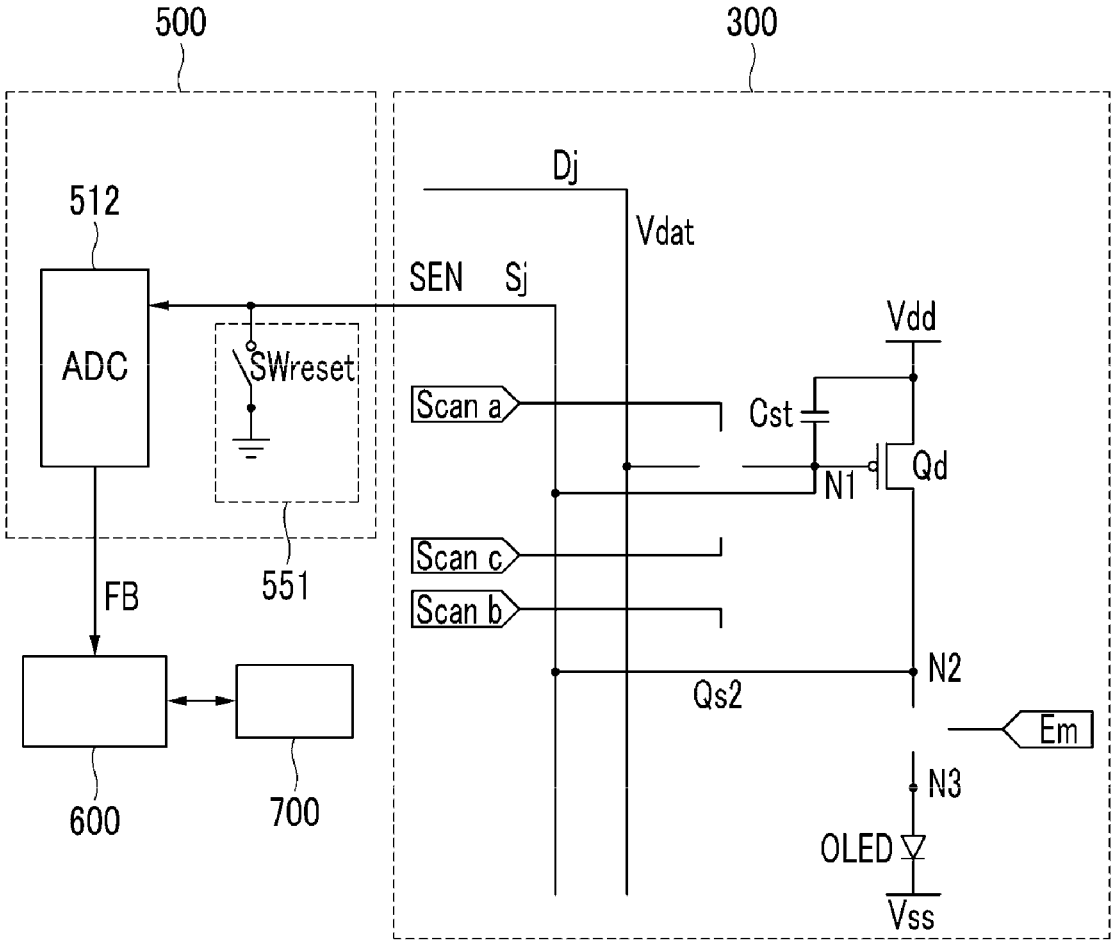
FIG. 3 is an equivalent circuit diagram when measuring a threshold voltage of a driving transistor of an organic light emitting device through the exemplary embodiment shown in FIG. 2.

FIG. 3 is an equivalent circuit diagram when measuring the threshold voltage Vth of the driving transistor Qd of the organic light emitting device through the exemplary embodiment shown in FIG. 2.

In the organic light emitting device shown in FIG. 2, the switch Se1 is in an on state and the switch SW3 of the mobility sensor 552 is in an off state. Also, the first scanning signal scan a and the third scanning signal Em are applied as the high voltage Voff, and the second scanning signal scan b and the fourth scanning signal scan c are applied as the low voltage Von. Through this application, the structure shown in FIG. 3 is formed. Here, the driving transistor Qd is diode-connected. The reset switch SWreset of the threshold voltage sensor 551 is turned on during a predetermined time and is turned off to measure the threshold voltage, that is, the voltage of the node N1. If the reset switch SWreset is turned on, the voltage of the node N1 is a ground as 0, and if the reset switch SWreset is turned off, the voltage of the node N1 is slowly increased. In the present exemplary embodiment, the node N1 is connected to the ground by the reset switch SWreset, however a DC voltage that is sufficiently lower than the driving voltage Vdd may be used according to an exemplary embodiment. After a predetermined time, the increasing of the voltage slows and a voltage of a constant degree is represented. This approximately constant voltage is a value of the threshold voltage Vth of the diode-connected driving transistor Qd subtracted from the driving voltage Vdd that is a voltage of the input terminal of the driving transistor Qd. Therefore, after the reset switch SWreset is turned off, if the voltage of the node N1 is measured after the predetermined time that the driving transistor Qd arrives at the threshold voltage Vth, the threshold voltage Vth may be obtained by subtracting the voltage of the node N1 from the driving voltage Vdd.

$$V_N = Vdd - |Vth| \quad \text{[Equation 1]}$$

Here, $V_N$ is a voltage of the node N1 when measuring the threshold voltage Vth.

The threshold voltage Vth may be stored or processed as it is as the voltage that is stored to the memory 700 or is processed in the signal controller 600, however the voltage value measured at the node N1 $V_N$ may be stored to the memory 700 or may be processed in the signal controller 600. When using the voltage measured at the node N1 $V_N$, a step for calculating the threshold voltage Vth may be removed such that a simple circuit may be manufactured.

On the other hand, it is preferable that the time that the voltage of the node N1 may be measured and calculated from the time that the reset switch SWreset is turned off, and the time may have a different value according to the characteristics of the display panel and may be determined when manufacturing the display panel.

Next, a method for measuring the mobility μ of the driving transistor Qd according to an exemplary embodiment of the present invention will be described with reference to FIG. 4.

Figure 4:
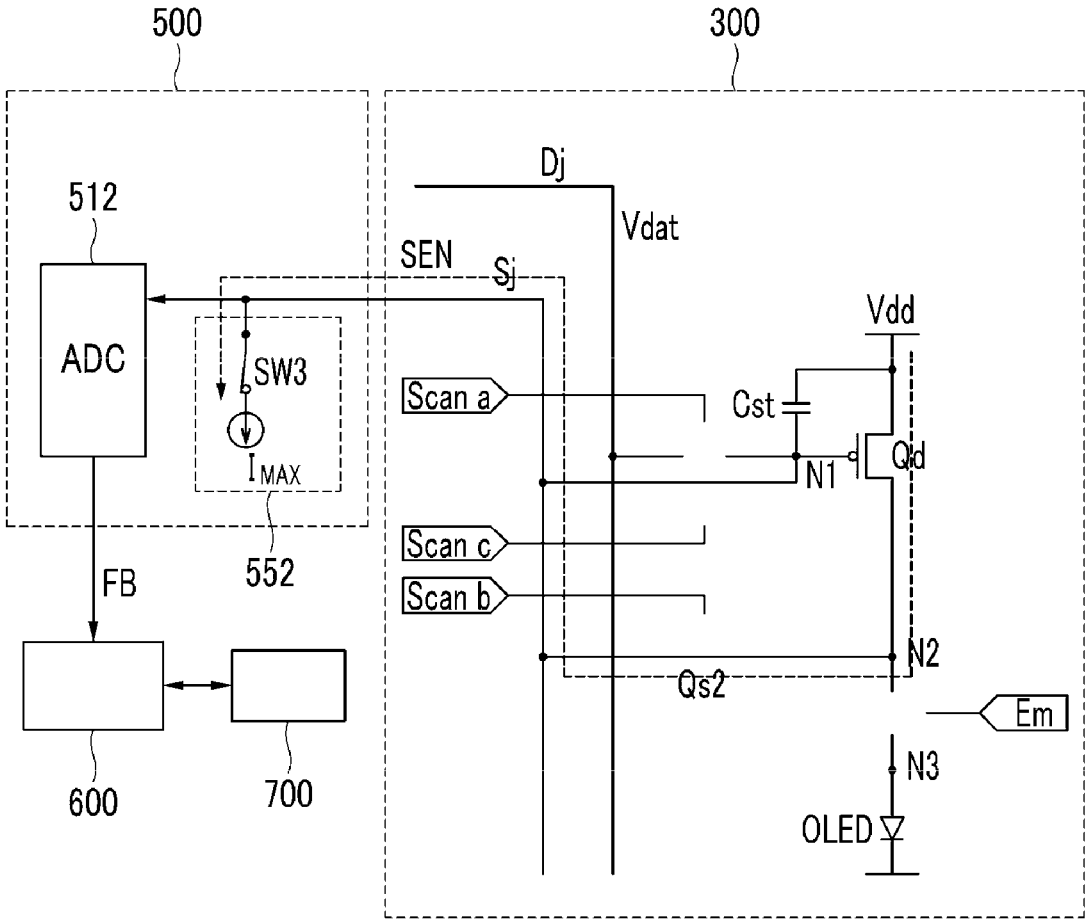
FIG. 4 is an equivalent circuit diagram when measuring mobility of a driving transistor through the exemplary embodiment shown in FIG. 2.

FIG. 4 is an equivalent circuit diagram when measuring the mobility μ of the driving transistor Qd through the exemplary embodiment shown in FIG. 2.

In the organic light emitting device shown in FIG. 2, the switch Se1 is in an on state and the reset switch SWreset of the threshold voltage sensor 551 is in an off state. Also, the first scanning signal scan a and the third scanning signal Em are applied as the high voltage Voff, and the second scanning signal scan b and the fourth scanning signal scan c are applied as the low voltage Von. Through this application, the structure shown in FIG. 4 is formed. Here, the driving transistor Qd is diode-connected. If the voltage of the node N1 is measured in the state in which the switch SW3 of the mobility sensor 552 is turned on to constantly flow a maximum current $I_{MAX}$ outside, the mobility μ may be obtained.

The method for obtaining the mobility μ will be described as follows.

Firstly, a current flowing in the driving transistor Qd may be represented as Equation 2.

$$I = \frac{1}{2}\mu C_{ox}\frac{W}{L}(V_{SG} - |V_{th}|)^2 \quad \text{[Equation 2]}$$

Here, μ is an electric field effect mobility, $C_{ox}$ is a capacity of a gate insulating layer per unit area, W is a width of a channel of the driving transistor Qd, L is a length of the channel of the driving transistor Qd, $V_{SG}$ is a voltage difference between the control terminal and the input terminal of the driving transistor Qd, and Vth is a hold voltage of the driving transistor Qd.

In FIG. 4, the current flowing in the driving transistor Qd is the maximum current $I_{MAX}$, and the voltage difference between the control terminal and the input terminal $V_{SG}$ may be rewritten as Equation 3.

$$I_{MAX} = \frac{1}{2}\mu C_{ox}\frac{W}{L}(V_{dd} - V_G - |V_{th}|)^2 \quad \text{[Equation 3]}$$

If Equation 2 may be summarized with reference to the voltage $V_G$ (a voltage of the control terminal of the driving transistor Qd is the value when the maximum current is flowed, and is represented as $V_{GMAX}$ in Equation 4), it may be represented as the below Equation 4.

$$V_{GMAX} = V_{dd} - |V_{th}| - \sqrt{\frac{2I_{MAX} \times L}{\mu C_{ox} \times W}} \quad \text{[Equation 4]}$$

Here, $V_{GMAX}$ is the voltage measured at the node N1 when measuring the mobility in FIG. 4, Vdd−|Vth| is a voltage $V_N$ measured at the node N1 when measuring the threshold voltage in FIG. 3, and $C_{ox}$, W, L, and $I_{MAX}$ are determined such that the mobility μ may be obtained.

The mobility μ may be stored or processed as it is as the data that is stored to the memory 700 or is processed in the signal controller 600, however the voltage value measured at the node N1 may be stored in the memory 700 or may be processed in the signal controller 600. When using the voltage measured at the node N1, a step for calculating the mobility μ may be eliminated such that a simple circuit may be manufactured.

Next, a method for measuring degradation of an organic light emitting element OLED according to an exemplary embodiment of the present invention will be described with reference to FIG. 5.

Figure 5:
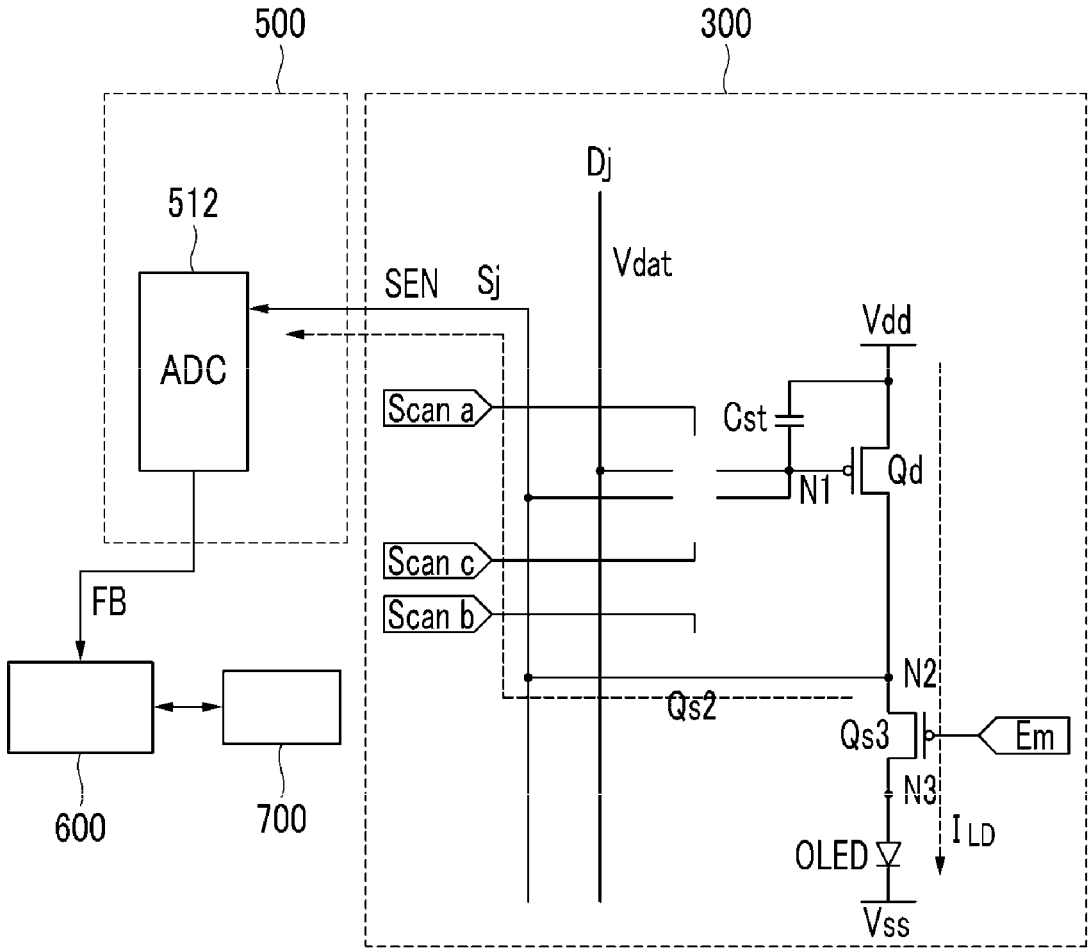
FIG. 5 is an equivalent circuit diagram when measuring degradation of an organic light emitting element through the exemplary embodiment shown in FIG. 2.

FIG. 5 is an equivalent circuit diagram when measuring degradation of the organic light emitting element OLED through the exemplary embodiment shown in FIG. 2.

In the organic light emitting device shown in FIG. 2, the switch Se1 is set to an on state and the reset switch SWreset of the threshold voltage sensor 551 and the switch SW3 of the mobility sensor 552 are maintained in the off state. Also, the second scanning signal scan b and the third scanning signal Em are applied as the low voltage Von, and the first scanning signal scan a and the fourth scanning signal scan c are applied as the high voltage Voff. Through this application, the structure shown in FIG. 5 is formed.

Here, the voltage of the node N2 generated by the current $I_{LD}$ output by the driving transistor Qd is measured to determine the degradation of the organic light emitting element OLED. That is, the degradation is determined by comparing the voltage of the node N2 and the luminance of the light emitted by the organic light emitting element OLED. For this determination, the lookup table may be used. Also, the degradation may be compensated when generating the luminance, and the degradation degree may be processed by using the lookup table.

In an exemplary embodiment of the present invention, the voltage of the node N2 is measured, and the voltage of the anode (the voltage of the node N3) of the organic light emitting element OLED may be measured. In the present exemplary embodiment, the voltage drop generated in the third switching transistor Qs3 may be considered by measuring the voltage of the node N2. Also, although the voltage drop generated in the second switching transistor Qs2 is slight, the voltage drop may be generated such that it is necessary to consider the second switching transistor Qs2. This will be described later referring to FIG. 14 or FIG. 21.

As above-described, the degradation of the organic light emitting element OLED is measured by comparing the voltage magnitude of the node N2 due to the flowing current $I_{LD}$ with reference to the applied data voltage Vdat with the reference value. Therefore, the current $I_{LD}$ must flow in the driving transistor Qd such that the first switching transistor Qs1 is applied with the low voltage Von to be turned on, and is again applied with the high voltage Voff. When the first switching transistor Qs1 is turned on, the data voltage Vdat flows to the node N1 and is stored in the capacitor Cst, and the driving transistor Qd is turned on through the voltage stored in the capacitor Cst such that the current $I_{LD}$ flows. Therefore, in the exemplary embodiment of FIG. 2, the degradation of the organic light emitting element OLED may be measured when the organic light emitting element OLED emits light.

As above-described, the threshold voltage Vth, the mobility μ, and the degradation of the organic light emitting element OLED may be measured at various times, and will be described with reference to FIG. 6, FIG. 7, FIG. 8, FIG. 9, FIG. 10, FIG. 11, FIG. 12 and FIG. 13.

Figure 6:
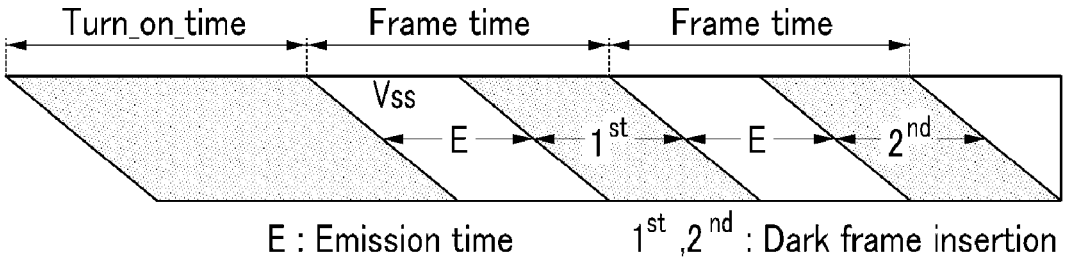
FIG. 6 is a view showing a turn-on interval and a frame interval of the organic light emitting device shown in FIG. 2.

Firstly, FIG. 6 shows a turn-on interval and a frame interval in the organic light emitting device.

FIG. 6 is a view showing the turn-on interval and the frame interval of the organic light emitting device shown in FIG. 2.

The turn-on interval (a turn-on time) is an interval after the application of the power to the organic light emitting device and before the display of the images of the display device. In this turn-on interval, it is possible to measure the threshold voltage Vth and the mobility μ of the driving transistor Qd.

The frame interval (a frame time) is an interval in which the organic light emitting device displays the luminance according to the input data to display the images. An exemplary embodiment of the present invention is an impulse driven display mode such that a black interval (dark frame insertion) displaying a black color during a predetermined time of one frame exists. The remaining time except for the black interval among the frame interval is an emission interval (an emission time) in which the organic light emitting element OLED emits the light. In one frame interval, the ratio of the black interval and the emission interval may be variously determined. That is, the black interval and the emission interval may be the same, and the emission interval may be longer or shorter than the black interval. However, when the black interval is longer than the emission interval, a drawback may be generated that the luminance of the display device may be decreased.

In the frame interval, it is possible to measure the threshold voltage Vth and the mobility μ of the driving transistor Qd in the black interval, and it is possible to measure the degradation of the organic light emitting element OLED in the emission interval.

As above-described, the threshold voltage Vth and the mobility μ of the driving transistor Qd, and the degradation of the organic light emitting element OLED, may be measured at different times from each other such that various exemplary embodiments may be represented according to the measuring times. Representative exemplary embodiments among them will be described with reference to FIG. 7, FIG. 8, FIG. 9, FIG. 10, FIG. 11, FIG. 12 and FIG. 13.

Firstly, the measuring of the threshold voltage Vth and the mobility μ in the turn-on interval will be described.

Figure 7:
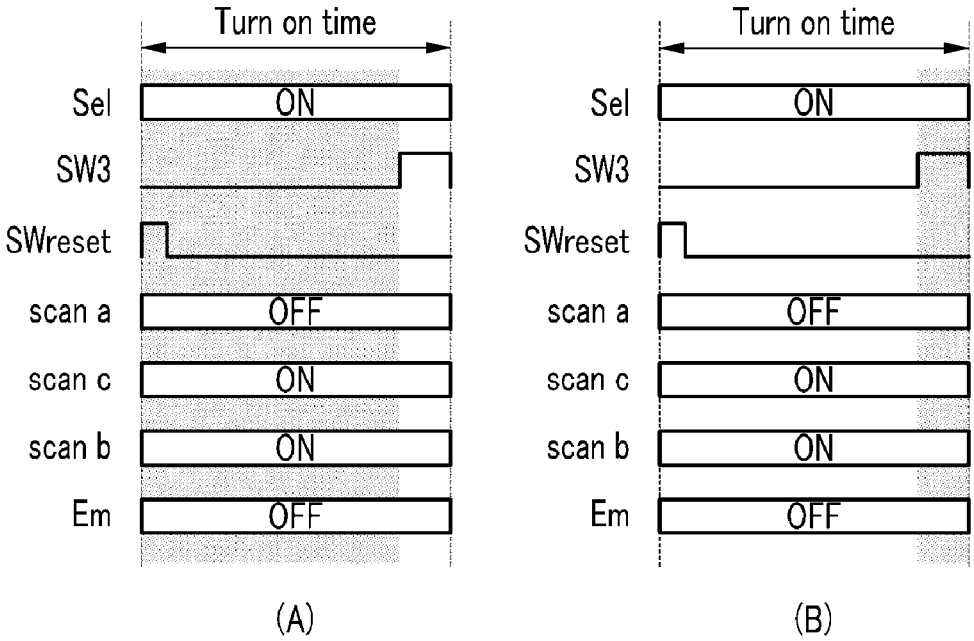
FIG. 7 is a waveform diagram of a signal applied when measuring a threshold voltage and mobility of the driving transistor shown in FIG. 2 in the turn-on interval of FIG. 6.

FIG. 7 is a waveform diagram of a signal applied when measuring a threshold voltage Vth and mobility μ of the driving transistor Qd shown in FIG. 2 in the turn-on interval of FIG. 6. FIG. 7(A) shows the interval measuring the threshold voltage Vth, and FIG. 7(B) shows the interval measuring the mobility μ.

That is, the switch Se1 is maintained in the on state in the turn-on interval when measuring the threshold voltage Vth and the mobility μ, the first scanning signal scan a and the third scanning signal Em are applied with the high voltage Voff, and the second scanning signal scan b and the fourth scanning signal scan c are applied with the low voltage Von.

On the other hand, to measure the threshold voltage Vth, the reset switch SWreset of the threshold voltage sensor 551 is turned on during the predetermined time and is then turned off. Here, the switch SW3 of the mobility sensor 552 is in the off state, referring to FIG. 7 (A).

On the other hand, to measure the mobility μ, the switch SW3 of the mobility sensor 552 is turned on. Here, the reset switch SWreset of the threshold voltage sensor 551 is maintained in the off state.

In the above-described state, the threshold voltage Vth and the mobility μ may be respectively obtained by using the voltage of the node N1 of FIG. 3 and FIG. 4.

Next, the measuring of the threshold voltage Vth, the mobility μ, and the degradation of the organic light emitting element OLED in the frame interval will be described.

Figure 8:
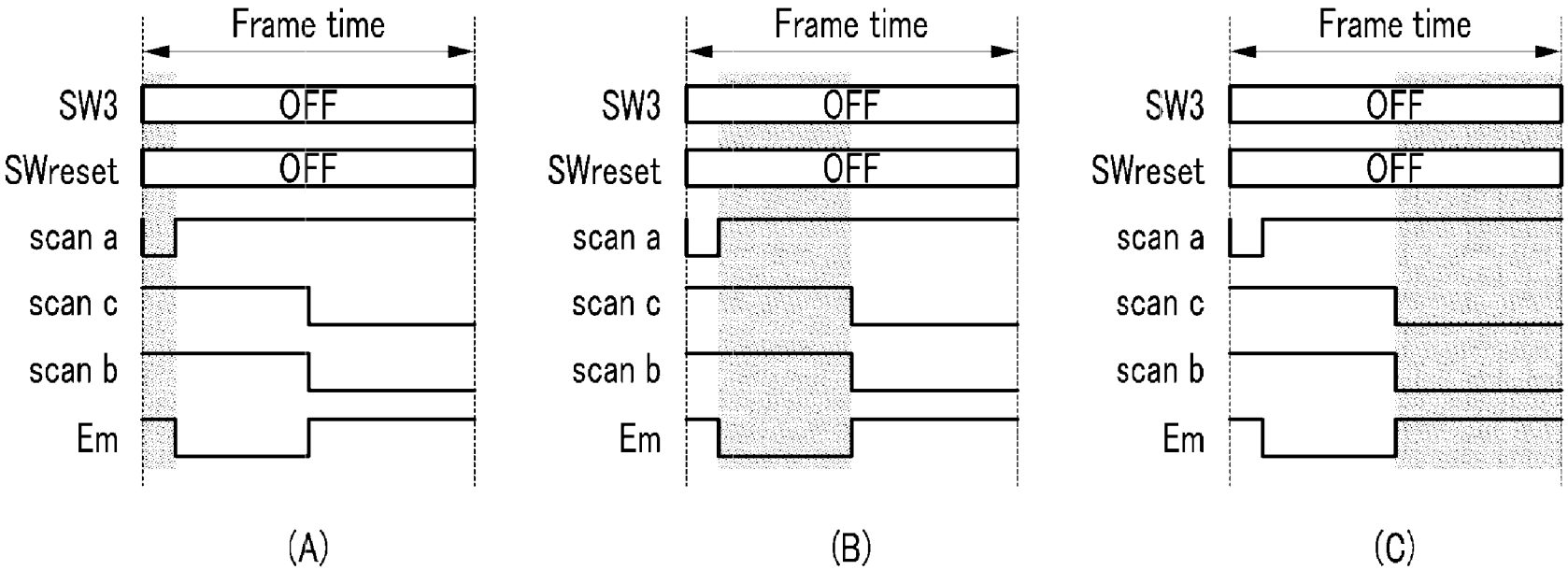
FIG. 8 is a waveform diagram of a signal applied to emit light from the organic light emitting device shown in FIG. 2 in the frame interval of FIG. 6.

Firstly, FIG. 8 shows a waveform of the frame interval when generally emitting according to the input data voltage.

FIG. 8 is a waveform diagram of a signal applied to emit light from the organic light emitting device shown in FIG. 2 in the frame interval of FIG. 6, FIG. 8(A) is a waveform of a programming interval, FIG. 8(B) is a waveform of an emission interval, and FIG. 8(C) is a waveform of a black interval.

That is, the first scanning signal scan a is applied with the low voltage Von in the programming interval of FIG. 8(A), and the data voltage Vdat is applied to the control terminal of the driving transistor Qd through the first switching transistor Qs1 and is stored to the capacitor Cst in FIG. 2. Here, the high voltage Voff is applied as the third scanning signal Em such that the driving transistor Qd is turned on and the third switching transistor is maintained in the off state even when the current $I_{LD}$ flows, and thereby the current does not flow into the organic light emitting element OLED. Also, the high voltage Voff is applied as the second scanning signal scan b and the fourth scanning signal scan c.

Next, the first scanning signal scan a is changed into the high voltage Voff in the emission interval of FIG. 8(B), and the third scanning signal Em is changed into the low voltage Von such that the current $I_{LD}$ emitted in the driving transistor Qd flows in the organic light emitting element OLED and thereby the light is emitted. Here, as in FIG. 8(A), the second and fourth scanning signals scan b and scan c are applied with the high voltage Voff.

Next, in the black interval of FIG. 8(C), the third scanning signal Em is again changed into the high voltage Voff such the current $I_{LD}$ does not flow in the organic light emitting element OLED. Here, the second scanning signal scan b and the fourth scanning signal scan c are changed into the low voltage Von such that the control terminal and the output terminal of the driving transistor Qd are initialized.

Figure 9:
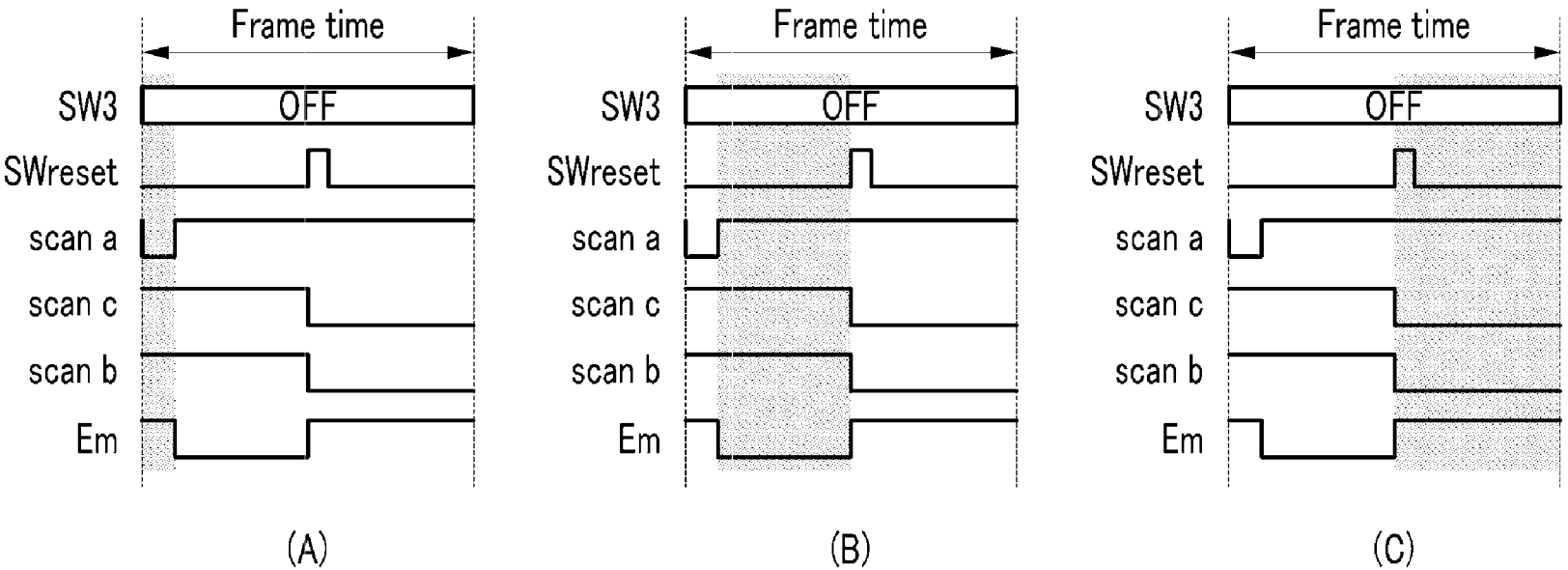
FIG. 9 is a waveform diagram of a signal applied when measuring a threshold voltage of the driving transistor shown in FIG. 2 in the frame interval of FIG. 6.

FIG. 9 shows an exemplary embodiment measuring the threshold voltage Vth by using the black interval of the frame interval.

FIG. 9 is a waveform diagram of a signal applied when measuring the threshold voltage Vth of the driving transistor Qd shown in FIG. 2 in the frame interval of FIG. 6.

The intervals of FIG. 9 (A) and (B) are the same as the intervals of FIG. 8 (A) and (B). That is, the programming interval and the emission interval are the same regardless of measuring the threshold voltage Vth such that the basic emission operation is executed. However, the reset switch SWreset of the threshold voltage sensor 551 becomes turned on and then turned off in the interval of FIG. 9 (C) such that the threshold voltage Vth may be measured in the interval (C) (i.e., the black interval). Here, the second scanning signal scan b and the fourth scanning signal scan c are applied with the low voltage Von, and the first scanning signal scan a and the third scanning signal Em are applied with the high voltage Voff.

Figure 10:
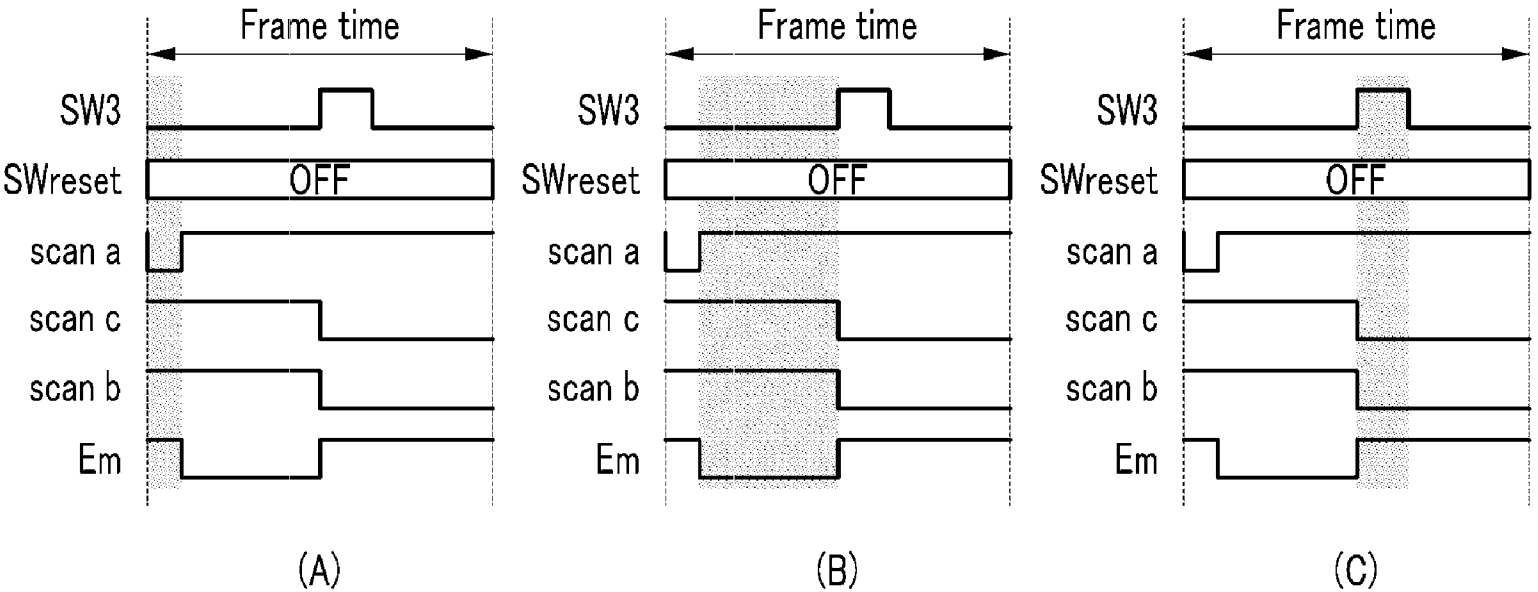
FIG. 10 is a waveform diagram of a signal applied when measuring a mobility of the driving transistor shown in FIG. 2 in the frame interval of FIG. 6.

On the other hand, FIG. 10 shows an exemplary embodiment measuring the mobility μ by using the black interval of the frame interval.

FIG. 10 is a waveform diagram of a signal applied when measuring the mobility μ of the driving transistor Qd shown in FIG. 2 in the frame interval of FIG. 6.

The intervals of FIG. 10 (A) and (B) are the same as the intervals of FIG. 8 (A) and (B). That is, the programming interval and the emission interval are the same regardless of measuring of the mobility μ such that the basic emission operation is executed. However, the switch SW3 of the mobility sensor 552 becomes turned on such that the mobility μ may be measured in the interval (C) (i.e., the black interval). Here, the second scanning signal scan b and the fourth scanning signal scan c are applied with the low voltage Von, and the first scanning signal scan a and the third scanning signal Em are applied with the high voltage Voff.

Figure 11:
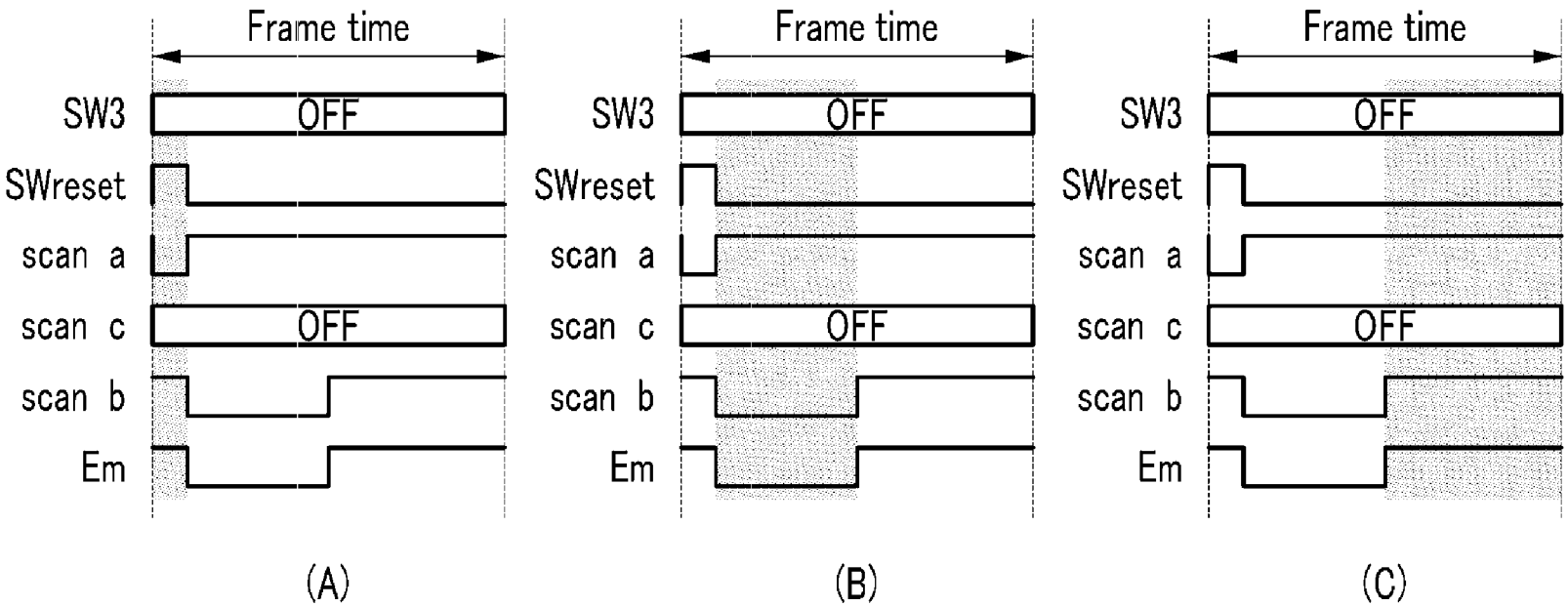
FIG. 11 is a waveform diagram of a signal applied when measuring a degradation of the organic light emitting element shown in FIG. 2 in the frame interval of FIG. 6.

On the other hand, FIG. 11 shows an exemplary embodiment measuring the degradation of the organic light emitting element OLED by using the programming interval and the emission interval of the frame interval.

FIG. 11 is a waveform diagram of a signal applied when measuring the degradation of the organic light emitting element OLED shown in FIG. 2 in the frame interval of FIG. 6.

The black interval of FIG. 11 (C) can be the same as the black interval of FIG. 8 (C). That is, the degradation of the organic light emitting element OLED is executed in the emission interval, and the programming interval, which prepares the emission interval are changed, however the general emission operation, for example, shown in FIG. 8, is executed in the black interval. As a result, the intervals of FIG. 11 (A) and (B) have the characteristics as follows.

In the programming interval of FIG. 11(A), the first scanning signal scan a is applied with the low voltage Von, and the reset switch SWreset of the threshold voltage sensor 551 is turned on. The first scanning signal scan a by preparing the emission interval is the same as in FIG. 8 (A), however to turn on the reset switch SWreset is to prevent the emission luminance from being changed by the current flow to the organic light emitting element OLED on the sensing line Sj when measuring the degradation of the organic light emitting element OLED. That is, the charges that may be generated on the sensing line Sj are removed through the reset switch SWreset connection to ground. Here, the second scanning signal scan b, the third scanning signal Em and the fourth scanning signal scan c are applied with the high voltage Voff.

Next, the second scanning signal scan b and the third scanning signal Em are applied with the low voltage Von in the emission interval of FIG. 11(B) that is changed from the high voltage Voff in the programming interval of FIG. 11(A). The third scanning signal Em applied with the low voltage Von, which is the same as in the emission interval of FIG. 8(B) is a signal for the emission of the organic light emitting element OLED, however the second scanning signal scan b measures the degradation of the organic light emitting element OLED by measuring the voltage applied to the node N2. Here, the first scanning signal scan a and the fourth scanning signal scan c are applied with the high voltage Voff.

As above-described, the method for measuring the degradation of the organic light emitting element OLED is described in the programming interval of FIG. 11(A) and the emission interval of FIG. 11(B).

However, the threshold voltage Vth of FIG. 9 and the mobility μ of FIG. 10 are measured in the black interval differently from FIG. 11 such that it is possible for the exemplary embodiment of FIG. 11 and the exemplary embodiment of FIG. 9 or FIG. 10 to be combined.

Figure 12:
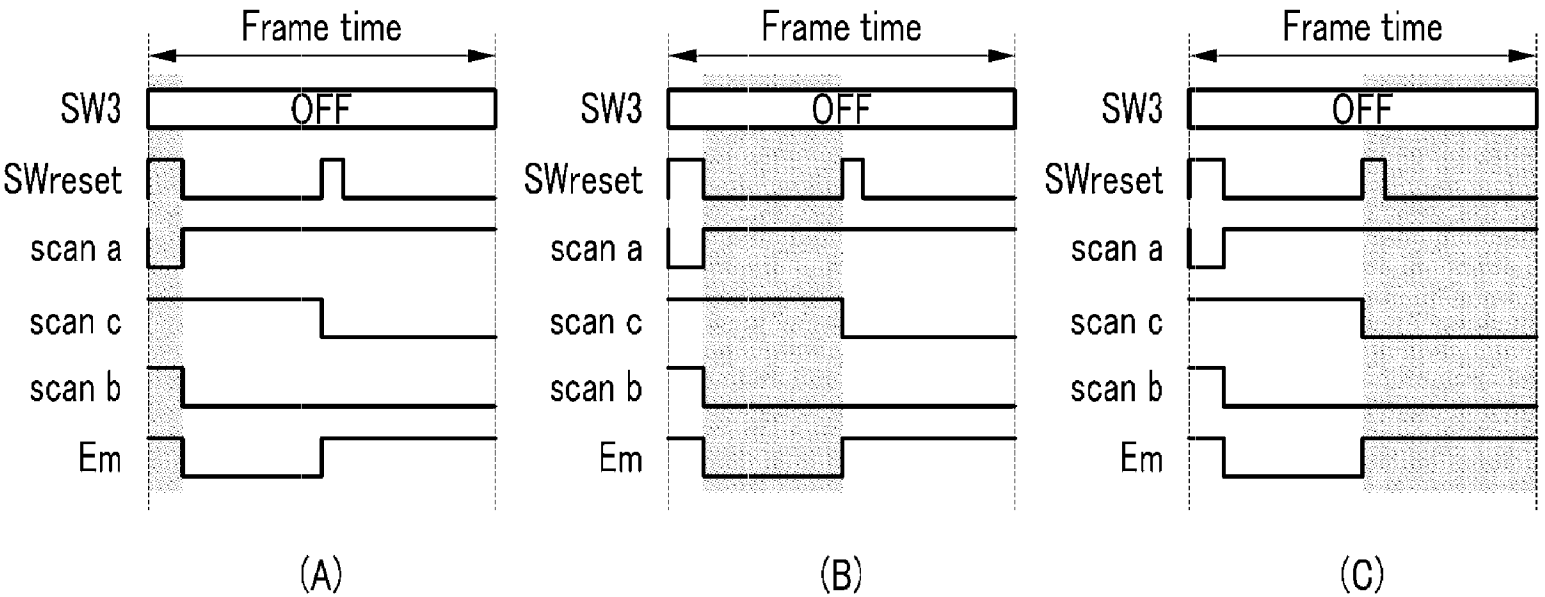
FIG. 12 is a waveform diagram of a signal applied when measuring a threshold voltage of the driving transistor shown in FIG. 2 and degradation of the organic light emitting element shown in FIG. 2 in the frame interval of FIG. 6.
Figure 13:
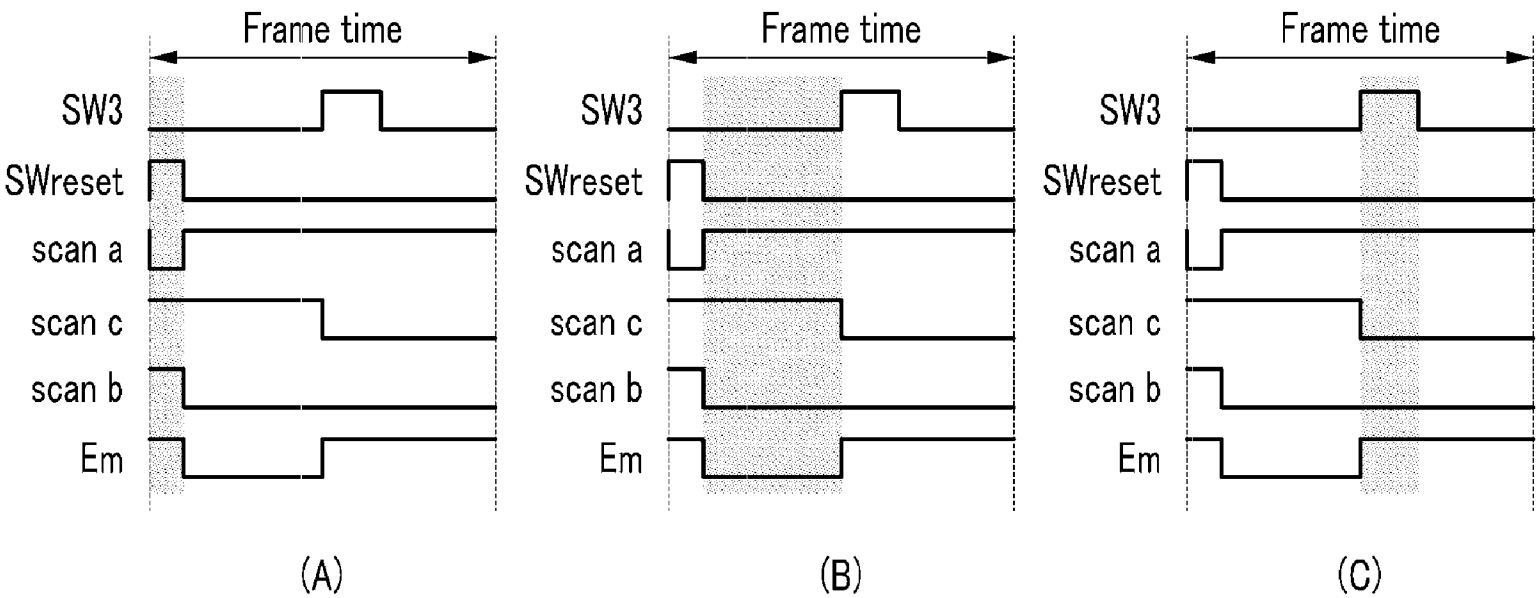
FIG. 13 is a waveform diagram of a signal applied when measuring a mobility of the driving transistor shown in FIG. 2 and a degradation of the organic light emitting element shown in FIG. 2 in the frame interval of FIG. 6.

FIG. 12 shows an exemplary embodiment in which the threshold voltage Vth and the degradation of the organic light emitting element OLED are measured together in the frame interval. FIG. 13 shows an exemplary embodiment in which the mobility μ and the degradation of the organic light emitting element OLED are measured together in the frame interval.

FIG. 12 is a waveform diagram of a signal applied when measuring the threshold voltage Vth of the driving transistor Qd shown in FIG. 2 and the degradation of the organic light emitting element OLED in the frame interval of FIG. 6. FIG. 13 is a waveform diagram of a signal applied when measuring the mobility μ of the driving transistor Qd shown in FIG. 2 and the degradation of the organic light emitting element OLED in the frame interval of FIG. 6.

FIG. 12 accords with the waveform of the sum of the steps of FIG. 11 (A) and (B) and the step of FIG. 9 (C). FIG. 13 accords with the waveform of the sum of the steps of FIG. 11 (A) and (B) and the step of FIG. 10 (C).

As a result, the degradation of the organic light emitting element OLED may be measured in the programming and emission intervals and the threshold voltage Vth may be measured in the black interval in the exemplary embodiment of FIG. 12, and the degradation of the organic light emitting element OLED may be measured in the programming and emission intervals and the mobility μ may be measured in the black interval in the exemplary embodiment of FIG. 13.

Figure 14:
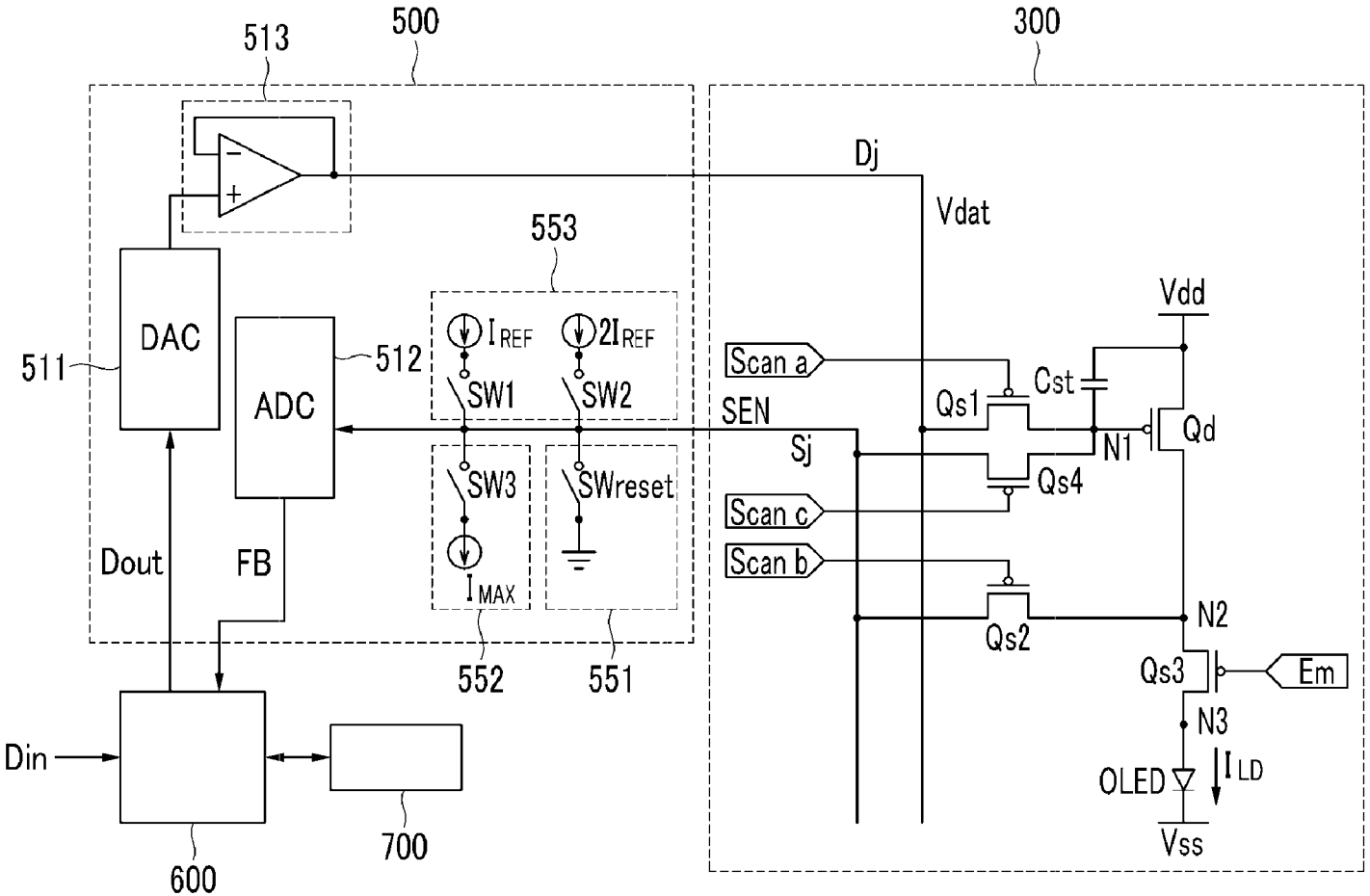
FIG. 14 shows an equivalent circuit diagram of a pixel in an organic light emitting device according to another exemplary embodiment of the present invention, along with a data driver, a signal controller, and a memory.
Figure 15:
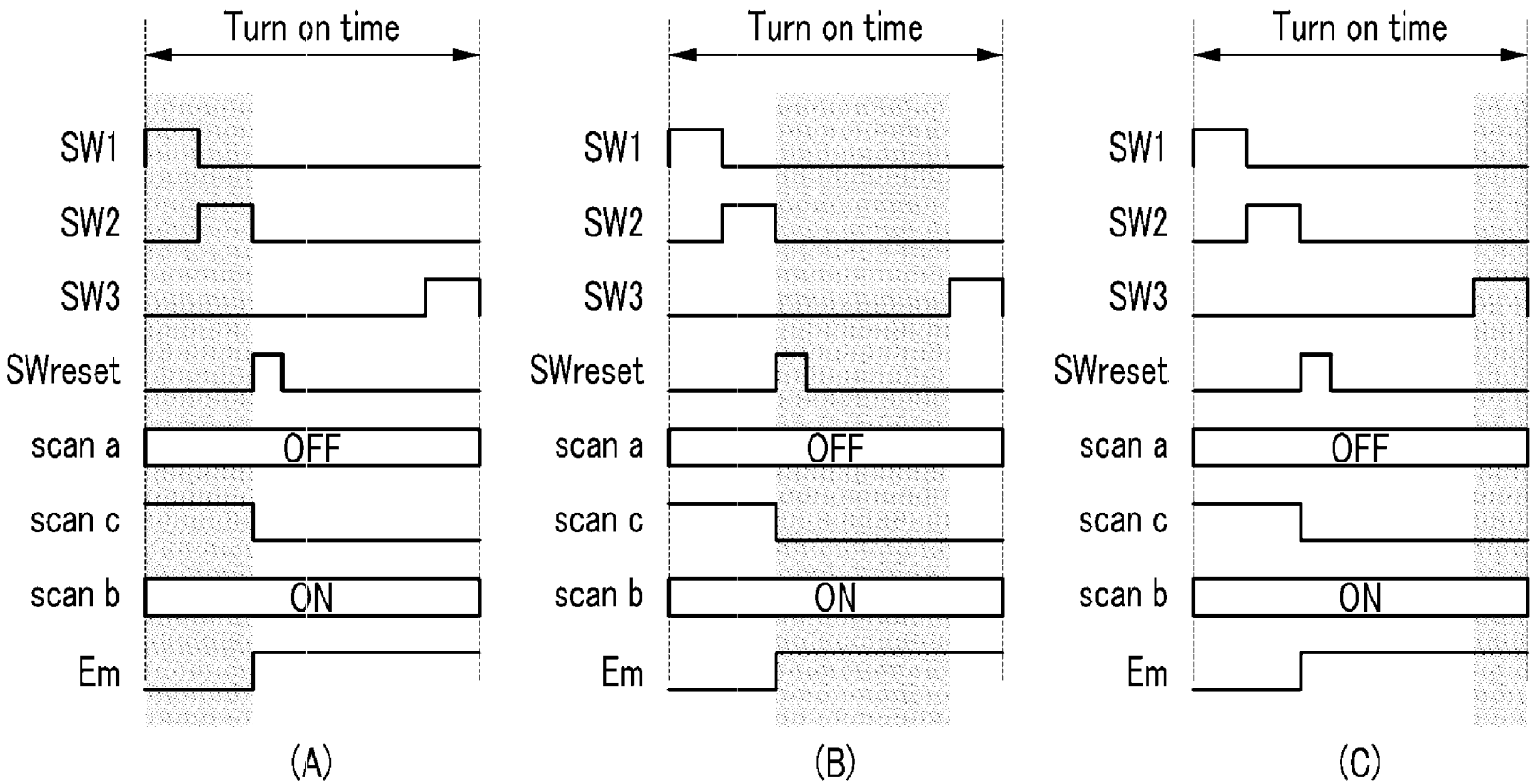
FIG. 15 is a waveform diagram of a signal applied when measuring degradation of the organic light emitting element, and threshold voltage and mobility of the driving transistor in the turn-on interval of FIG. 14.

FIG. 14 shows an equivalent circuit diagram of the pixel PX in the organic light emitting device according to another exemplary embodiment of the present invention, along with the data driver 500, the signal controller 600, and the memory 700, and FIG. 15 is a waveform diagram of a signal applied when measuring the degradation of the organic light emitting element OLED, and the threshold voltage Vth, and the mobility μ of the driving transistor Qd of FIG. 14 in the turn-on interval of FIG. 6.

In FIG. 14, the data driver 500 additionally includes a degradation sensor 553, differently from FIG. 2. The degradation sensor 553 includes two current sources $I_{REF}$ and $2I_{REF}$, and two switches SW1 and SW2.

When sensing the degradation through the node voltage (node N3 voltage) of the organic light emitting element OLED, the degradation sensor 553 respectively applies two current sources $I_{REF}$ and $2I_{REF}$ such that the voltage drop due to the second switching transistor Qs2, the third switching transistor Qs3 and the sensing line Sj that are formed before the node N3, may be calculated, and thereby the degradation may be further correctly determined through the voltage of the node N3. The method of determining the voltage of the node N3 depends on the method of determining the voltage drop generated from the switching elements Qs2 and Qs3, and the sensing line Sj. In this embodiment, this voltage drop is calculated from the voltage measured through the two current sources $I_{REF}$ and $2I_{REF}$, and the measured voltage of the node N3 is amended based on the calculated voltage to obtain the voltage of the node N3. As shown in FIG. 14, one current source applies the reference current $I_{REF}$, and the other current source applies the current $2I_{REF}$ that is two times the reference current $I_{REF}$. However, various current values may be applied according to an exemplary embodiment, and an additional current source may be added.

A waveform of FIG. 15 will be described below.

It is possible to measure the degradation of the organic light emitting element OLED in the turn-on interval in FIG. 6.

Firstly, FIG. 15 (A) shows the waveform when measuring the degradation of the organic light emitting element OLED in the turn-on interval.

The first scanning signal scan a and the fourth scanning signal scan c are applied with the high voltage Voff, and the second scanning signal scan b and the third scanning signal Em are applied with the low voltage Von. Also, the reset switch SWreset of the threshold voltage sensor 551 and the switch SW3 of the mobility sensor 552 regardless to the sensing of the degradation are kept in the off state. Next, two switches SW1 and SW2 of the degradation sensor 553 are sequentially turned on.

Then, the measured voltages are calculated and the voltage of the node N3 is obtained.

Next, FIG. 15 (B) shows a waveform when measuring the threshold voltage Vth.

Two switches SW1 and SW2 of the degradation sensor 553 and the switch SW3 of the mobility sensor 552 regardless of the threshold voltage Vth are maintained in the off state, the first scanning signal scan a and the third scanning signal Em are applied with the high voltage Voff, and the second scanning signal scan b and the fourth scanning signal scan c are applied with the low voltage Von. Here, the voltage is measured after the predetermined time after the reset switch SWreset of the threshold voltage sensor 551 is turned on and then is turned off to calculate the threshold voltage.

Next, FIG. 15 (C) shows a waveform when measuring the mobility μ.

The reset switch SWreset of the threshold voltage sensor 551 and the two switches SW1 and SW2 of the degradation sensor 553 regardless of the measuring of the mobility μ are maintained in the off state, the first scanning signal scan a and the third scanning signal Em are applied with the high voltage Voff, and the second scanning signal scan b and the fourth scanning signal scan c are applied with the low voltage Von. Also, the switch SW3 of the mobility sensor 552 is turned on to calculate the mobility μ through the calculation.

In the exemplary embodiment of FIG. 15, the threshold voltage Vth is measured after measuring the degradation, and the mobility μ is measured after measuring the threshold voltage Vth. However, this sequence corresponds to the present exemplary embodiment, and the order may be freely changed.

FIG. 16, FIG. 17, FIG. 18 and FIG. 19 show another exemplary embodiment of modifying the configuration of FIG. 2.

Firstly, a structure of FIG. 16 will be described below.

Figure 16:
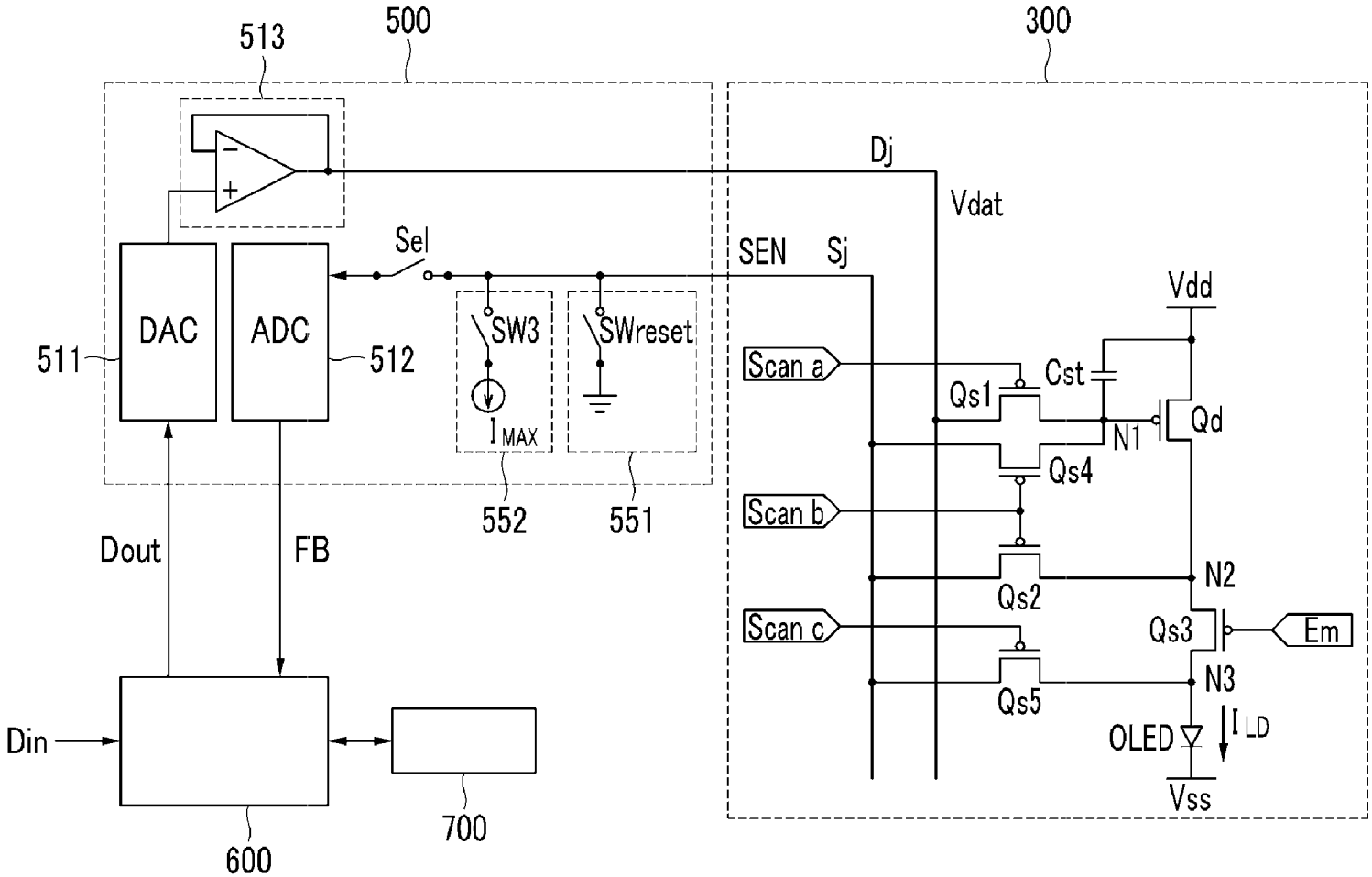
FIG. 16 shows an equivalent circuit diagram of a pixel in an organic light emitting device according to another exemplary embodiment of the present invention, along with a data driver, a signal controller, and a memory.

FIG. 16 shows an equivalent circuit diagram of the pixel PX in the organic light emitting device according to another exemplary embodiment of the present invention, along with the data driver 500, the signal controller 600, and the memory 700.

In the exemplary embodiment of FIG. 16, differently from the exemplary embodiment of FIG. 2, a fifth switching transistor Qs5 is additionally formed, and the fifth switching transistor Qs5 is connected to the node N3 and the sensing line Sj. That is, the fifth switching transistor Qs5 as a transistor used to sense the degradation of the organic light emitting element OLED may directly measure the voltage of the node N3 (the voltage of the anode of the organic light emitting element OLED). As a result, the degradation sensor 553 may not be additionally formed in the data driver 500.

Also, the second switching transistor Qs2 and the fourth switching transistor Qs4 are controlled by the second scanning signal scan b, and the added fifth switching transistor Qs5 is controlled by the fourth scanning signal scan c.

A method of measuring the threshold voltage Vth, the mobility μ, and the degradation of the organic light emitting element OLED through the exemplary embodiment of FIG. 16 will be described with reference to FIG. 17, FIG. 18 and FIG. 19.

Figure 17:
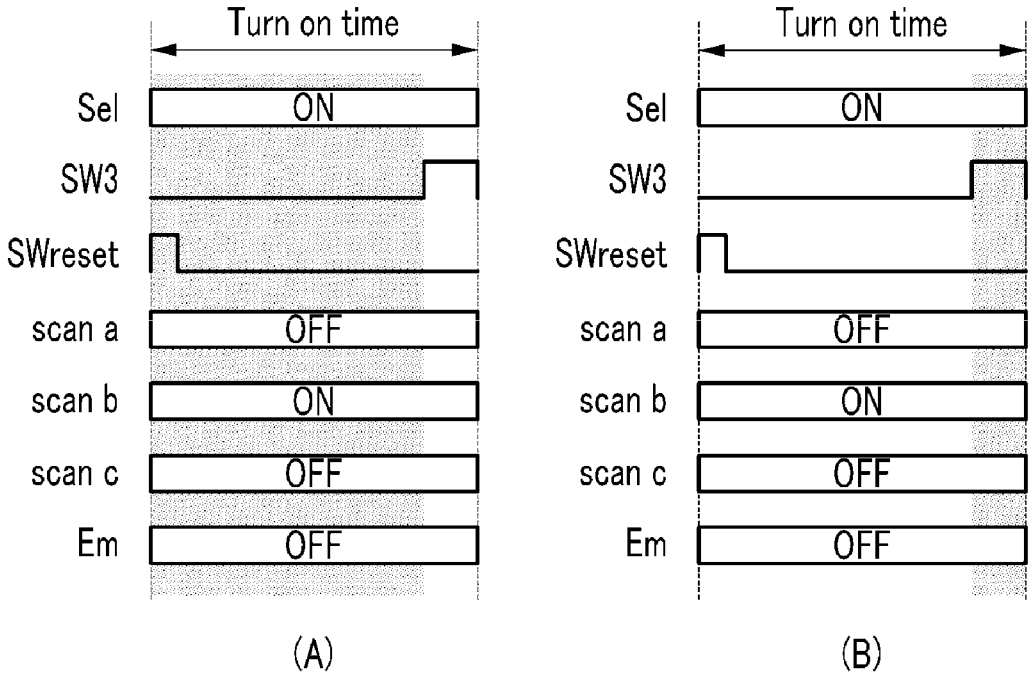
FIG. 17 is a waveform diagram of a signal applied when measuring a threshold voltage and mobility of the driving transistor of FIG. 16 in the turn-on interval.

Firstly, FIG. 17 shows a case of measuring the threshold voltage Vth and the mobility μ in the turn-on interval.

FIG. 17 is a waveform diagram of a signal applied when measuring the threshold voltage Vth and the mobility μ of the driving transistor Qd of FIG. 16 in the turn-on interval.

The waveform of FIG. 17 is similar to the waveform of FIG. 7. In the waveform of FIG. 7, the second scanning signal scan b and the fourth scanning signal scan c that are separated from each other are applied with the same signal controlling the second switching transistor Qs2 and the fourth switching transistor Qs4, respectively. However, the second scanning signal scan b may be applied to the control terminals of the second switching transistor Qs2 and the fourth switching transistor Qs4 together as one as shown in FIG. 17. Also, the fourth scanning signal scan c controlling the fifth switching transistor Qs5 is applied with the high voltage Voff such that the off state is maintained in FIG. 17.

FIG. 17 is a waveform diagram of a signal applied when measuring the threshold voltage Vth and the mobility μ of the driving transistor Qd of FIG. 16 in the turn-on interval, wherein FIG. 17 (A) is an interval measuring the threshold voltage Vth and FIG. 17 (B) is an interval measuring the mobility μ.

That is, the switch Se1 is maintained in the on state when measuring the threshold voltage Vth and the mobility μ in the turn-on interval. Also, the first scanning signal scan a, the third scanning signal Em, and the fourth scanning signal scan c are applied with the high voltage Voff, and the second scanning signal scan b is applied with the low voltage Von when measuring the threshold voltage Vth and the mobility μ in the turn-on interval.

Furthermore, to measure the threshold voltage Vth, the reset switch SWreset of the threshold voltage sensor 551 is turned on during the predetermined time and then is turned off. Here, the switch SW3 of the mobility sensor 552 is in the off state.

Furthermore, the switch SW3 of the mobility sensor 552 is turned on to measure the mobility μ. Here, the reset switch SWreset of the threshold voltage sensor 551 is maintained in the off state.

In the above-described state, the threshold voltage Vth and the mobility μ may be respectively obtained by using the voltage of the node N1 of FIG. 16.

Figure 18:
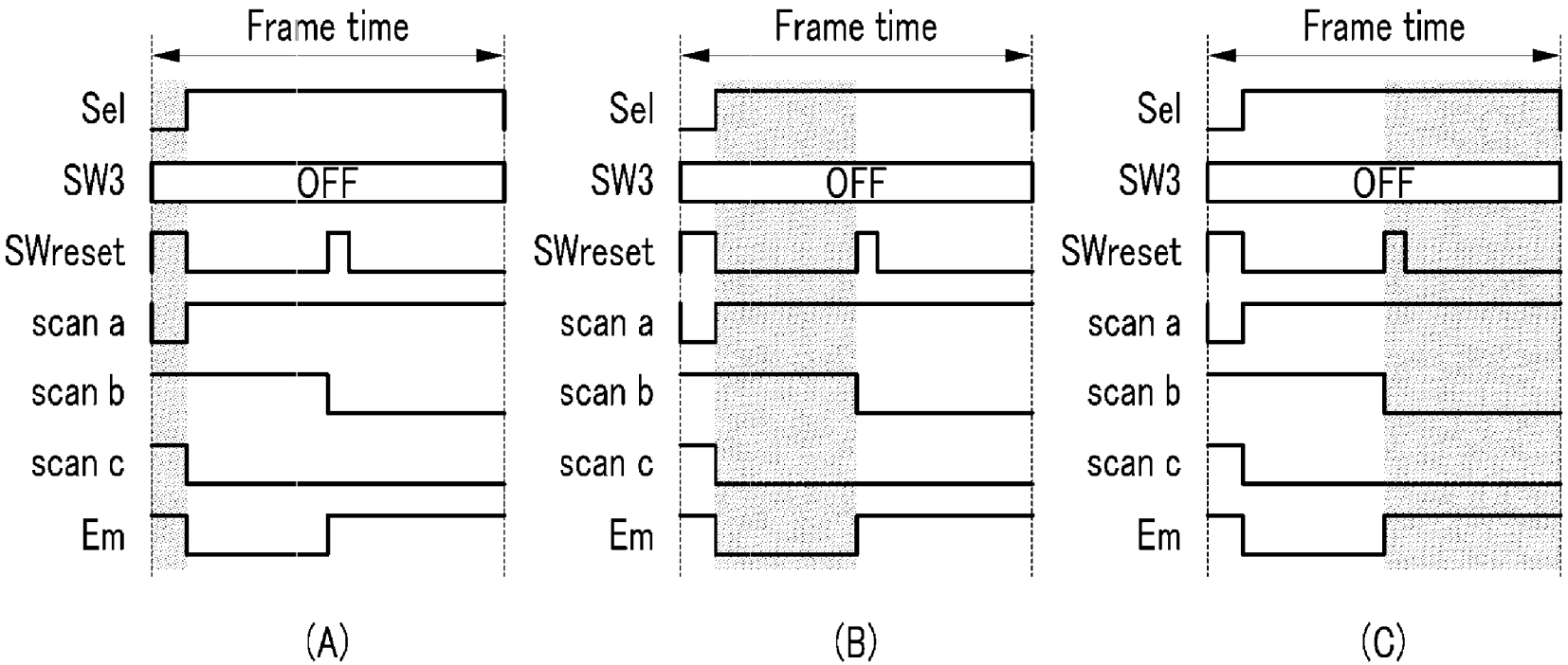
FIG. 18 is a waveform diagram of a signal applied when measuring a threshold voltage of the driving transistor and degradation of the organic light emitting element shown in FIG. 16 in the frame interval.
Figure 19:
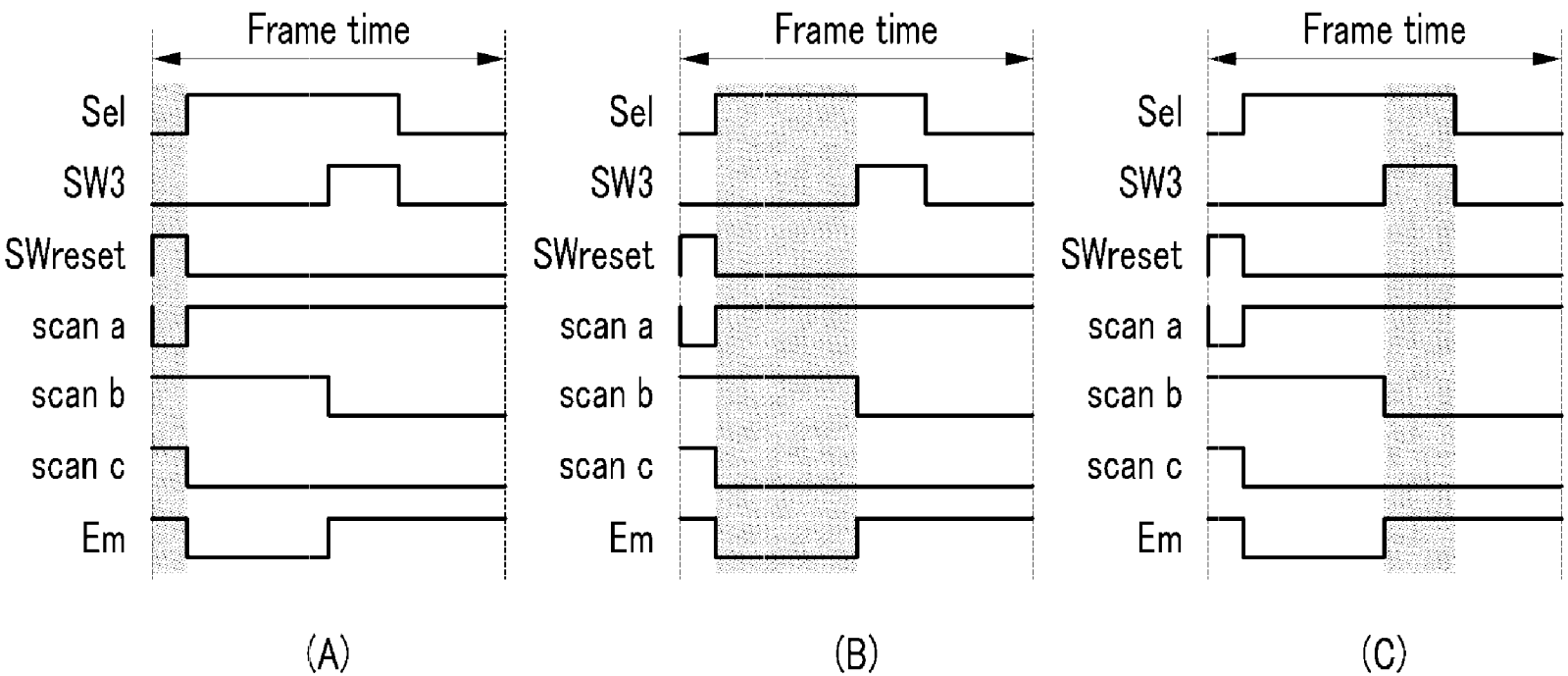
FIG. 19 is a waveform diagram of a signal applied when measuring mobility of the driving transistor and degradation of the organic light emitting element shown in FIG. 16 in the frame interval.

On the other hand, FIG. 18 and FIG. 19 show an exemplary embodiment of measuring the threshold voltage Vth and the mobility μ along with the measuring of the degradation of the organic light emitting element OLED in the frame interval.

FIG. 18 is a waveform diagram of a signal applied when measuring the threshold voltage Vth of the driving transistor Qd shown in FIG. 16 and the degradation of the organic light emitting element OLED in the frame interval, and FIG. 19 is a waveform diagram of a signal applied when measuring the mobility μ of the driving transistor Qd shown in FIG. 16 and degradation of the organic light emitting element OLED in the frame interval.

Firstly, FIG. 18 will be described.

In the exemplary embodiment of FIG. 18, the switch Se1 is turned on only during the interval measuring the degradation of the organic light emitting element OLED and the interval measuring the threshold voltage Vth, and is turned off for the remainder. Also, the switch SW3 of the mobility sensor 552 is maintained in the off state.

The first scanning signal scan a is applied with the low voltage Von only during the programming interval (A) and with the high voltage Voff during the remaining time, and the second scanning signal scan b is applied with the low voltage Von during the black interval (C) measuring the threshold voltage Vth and with the high voltage Voff during the remaining time. The third scanning signal Em is applied with the low voltage Von only during the emission interval (B) and with the high voltage Voff for the remaining time, and the fourth scanning signal scan c is applied with the low voltage Von for the emission interval (B) measuring the degradation of the organic light emitting element OLED. On the other hand, the fourth scanning signal scan c of the present exemplary embodiment is applied with the high voltage Voff during the programming interval (A), however the low voltage Von is applied during the black interval (C). This is to remove charges when the charges are accumulated at the sensing line Sj, and the charges are eliminated when the reset switch SWreset is turned on. However, the fourth scanning signal scan c may be applied with the low voltage Von only during the emission interval (B) according to the exemplary embodiment.

The reset switch SWreset is in an on state for the programming interval (A) and a portion of the black interval (C). The on state in the programming interval (A) is to remove the remaining charge on the sensing line Sj, and is not necessary such that it may be omitted according to the exemplary embodiment. Also, the reset switch SWreset is turned on at the initial part of the black interval (C) such that the node N1 is grounded, and then the voltage of the node N1 is measured after the predetermined time to obtain the threshold voltage Vth.

On the other hand, FIG. 19 is a waveform diagram of a signal applied in an exemplary embodiment of measuring the degradation of the organic light emitting element OLED and the mobility μ of the driving transistor Qd.

In the exemplary embodiment of FIG. 19, the switch Se1 is turned on only for the interval (B) measuring the degradation of the organic light emitting element OLED and the interval (C) measuring the mobility μ of the driving transistor Qd, and is turned off for the remaining time. Also, the reset switch SWreset of the threshold voltage sensor 551 is maintained with the off state except at the programming interval (A). The reset switch SWreset is turned on for the programming interval (A) in FIG. 19 to remove the charge stored on the sensing line Sj, but this is not necessary, such that the reset switch SWreset may have the off state at all intervals according to the exemplary embodiment, differently from FIG. 19.

The first scanning signal scan a is applied with the low voltage Von only at the programming interval (A) and is applied with the high voltage Voff at the remaining time, and the second scanning signal scan b is applied with the low voltage Von at the black interval (C) measuring the mobility μ and is applied with the high voltage Voff at the remaining time. The third scanning signal Em is applied with the low voltage Von only at the emission interval (B) and is applied with the high voltage Voff at the remaining time, and the fourth scanning signal scan c is applied with the low voltage Von at the emission interval (B) measuring the degradation of the organic light emitting element OLED. On the other hand, the fourth scanning signal scan c of the present exemplary embodiment is applied with the high voltage Voff at the programming interval (A), however it is applied with the low voltage Von at the black interval (C). This is to remove the charges when the charges are accumulated to the sensing line Sj, and the charges are eliminated when the reset switch SWreset is turned on. However, the fourth scanning signal scan c may be applied with the low voltage Von only at the emission interval (B) according to the exemplary embodiment.

The switch SW3 has the on state at the portion of the black interval (C), and the off state at the remaining time. The mobility μ is detected when the switch SW3 is in the on state, and the interval in which the switch SW3 is in the on state may be during the whole black interval (C), differently from the exemplary embodiment of FIG. 19.

On the other hand, in the structure of FIG. 16, the degradation sensor 553 may be additionally formed to the data driver 500.

Figure 20:
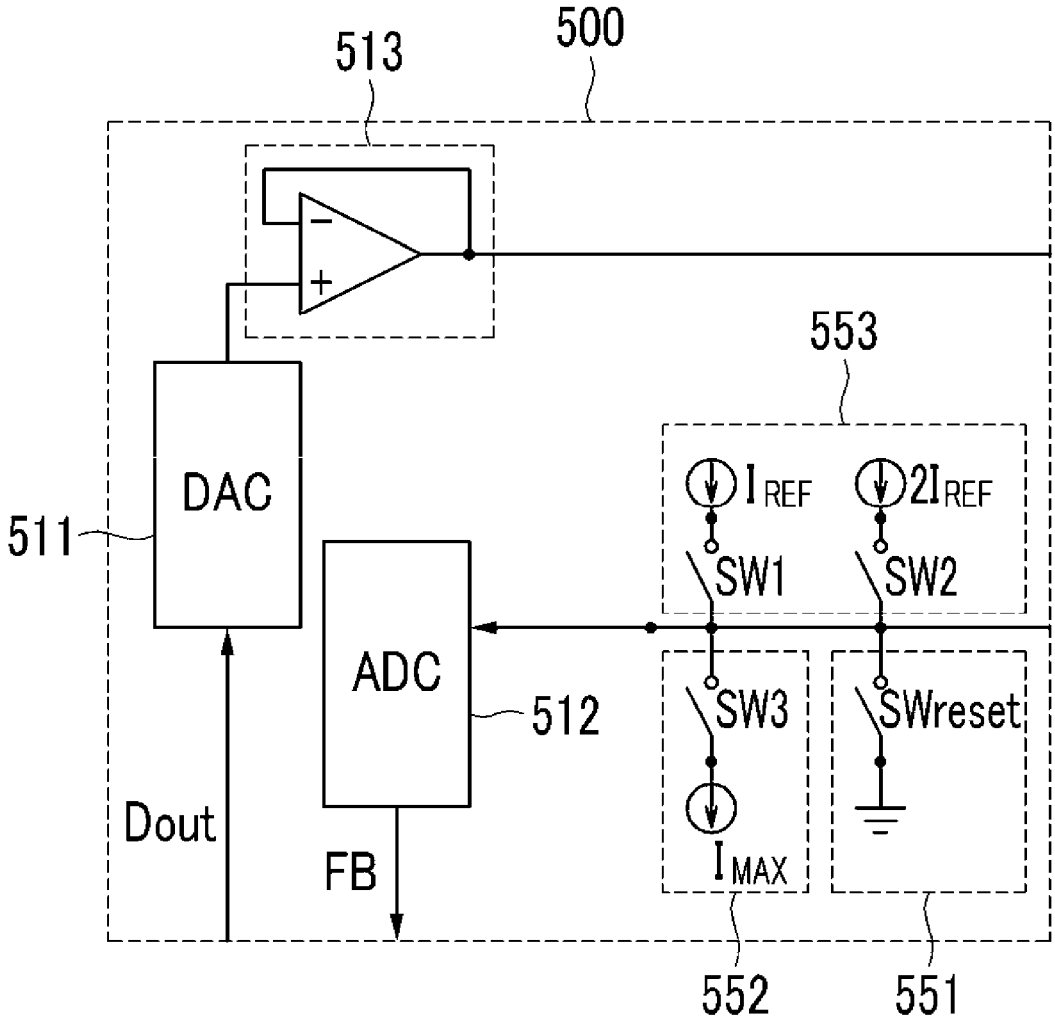
FIG. 20 is an equivalent circuit diagram showing a portion of the exemplary embodiment shown in FIG. 16 including an exemplary embodiment of a degradation sensor.

FIG. 20 is an equivalent circuit diagram of the portion of an exemplary embodiment in which the degradation sensor 553 is added to the exemplary embodiment of FIG. 16.

When sensing the degradation of the organic light emitting element OLED in the exemplary embodiment of FIG. 16, the degradation sensor 553 may be added to the exemplary embodiment of FIG. 16.

Figure 21:
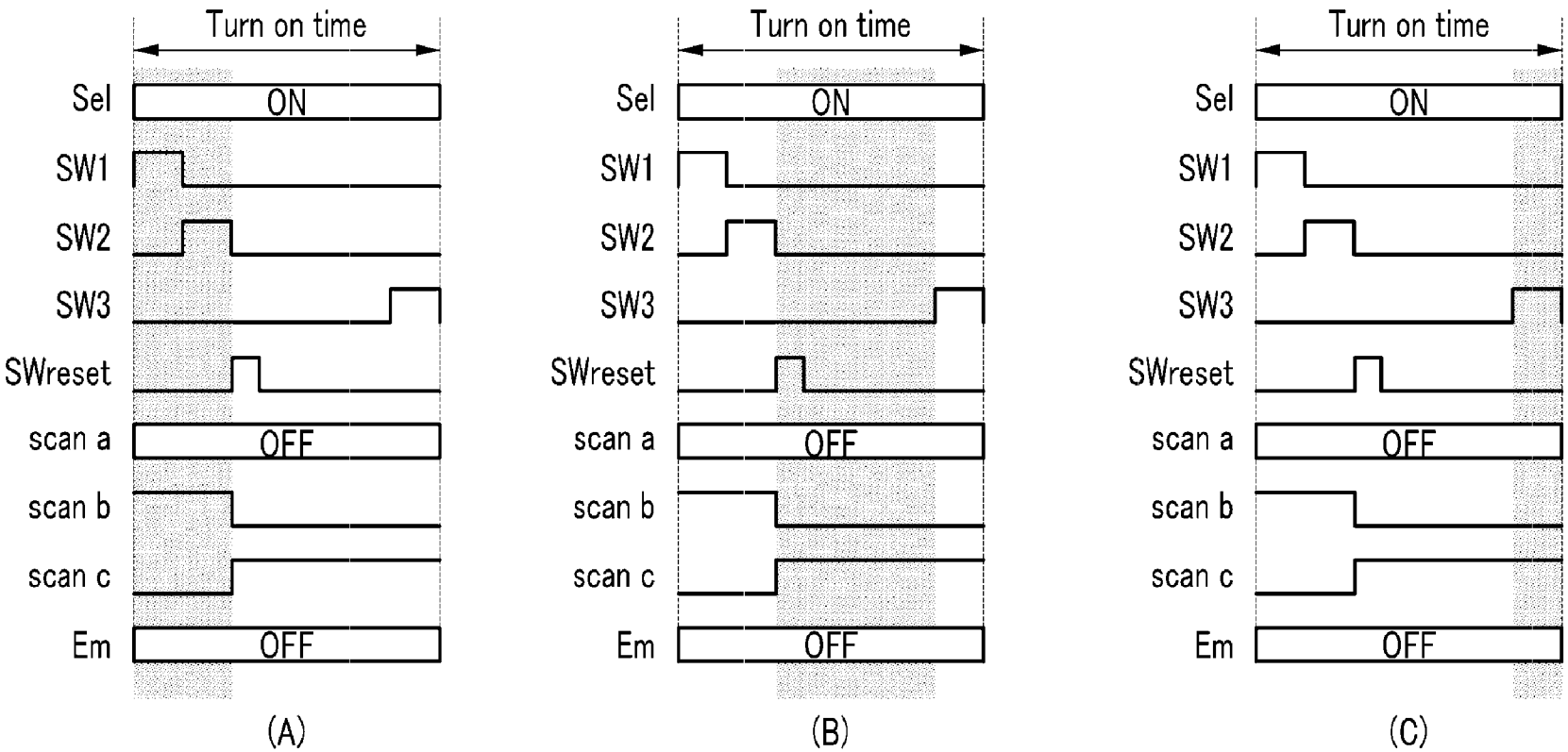
FIG. 21 is a waveform diagram of a signal applied when measuring degradation of the organic light emitting element, and threshold voltage and mobility of the driving transistor in the turn-on interval of FIG. 20.

FIG. 21 is a waveform diagram showing a signal applied when measuring the degradation of the organic light emitting element OLED, and when measuring the threshold voltage Vth, and the mobility μ of the driving transistor Qd of FIG. 16 using the degradation sensor 553 of FIG. 20 in the turn-on interval.

Firstly, the degradation of the organic light emitting element OLED is measured in the emission interval in the exemplary embodiment of FIG. 16, however it is possible to measure the degradation of the organic light emitting element OLED in the turn-on interval in the exemplary embodiment of FIG. 20.

Firstly, FIG. 21 (A) shows the waveform when measuring the degradation of the organic light emitting element OLED in the turn-on interval.

The first scanning signal scan a, the second scanning signal scan b, and the third scanning signal Em are applied with the high voltage Voff, and the fourth scanning signal scan c is applied with the low voltage Von. Also, the reset switch SWreset of the threshold voltage sensor 551 and the switch SW3 of the mobility sensor 552, regardless of the detection of the degradation, remain in the off state. Next, two switches SW1 and SW2 of the degradation sensor 553 are sequentially turned on. The detection is continually executed at the turn-on interval such that the switch Se1 is maintained in the on state.

Accordingly, the voltage of the node N3 is measured.

Next, FIG. 21 (B) shows a waveform when measuring the threshold voltage Vth.

The switch SW3 of the mobility sensor 552 and two switches SW1 and SW2 of the degradation sensor 553 regardless of the measuring of the threshold voltage Vth are maintained in the off state, the first scanning signal scan a, the third scanning signal Em, and the fourth scanning signal scan c are applied with the high voltage Voff, and the second scanning signal scan b is applied with the low voltage Von. Here, the reset switch SWreset of the threshold voltage sensor 551 is turned on and then is turned off, and the voltage of the node N1 is measured after the predetermined time to calculate the threshold voltage Vth. The detection is executed in the turn-on interval such that the Se1 switch is continually maintained in the on state.

Next, FIG. 21 (C) shows a waveform when measuring the mobility μ.

The switch SW3 of the mobility sensor 551 and two switches SW1 and SW2 of the degradation sensor 553 regardless of the measuring of the mobility μ are maintained in the off state, the first scanning signal scan a, the third scanning signal Em, and the fourth scanning signal scan c are applied with the high voltage Voff, and the second scanning signal scan b is applied with the low voltage Von. Also, the switch SW3 of the mobility sensor 552 is turned on and the mobility μ is produced through calculation. The sensing is continually executed at the turn-on interval such that the switch Se1 is maintained in the on state.

In the exemplary embodiment of FIG. 21, the threshold voltage Vth is measured after measuring the degradation, and the mobility μ is measured after measuring the threshold voltage Vth. However, the sequence thereof only corresponds to the present exemplary embodiment, and a change of the sequence is possible.

The measuring of the degradation of the organic light emitting element OLED, and the measuring of the threshold voltage Vth and the mobility μ of the driving transistor Qd, per each exemplary embodiment have been described.

Hereafter, a method for amending a data voltage Vdat applied to the pixel will be described by using the degradation of the organic light emitting element OLED, the threshold voltage Vth of the driving transistor Qd, and the mobility μ of the driving transistor Qd.

The above described Equation 2 is a relationship equation for the current flowing in the driving transistor Qd. Here, the applied current I is changed by the gray value and the degradation degree of the organic light emitting element OLED, and a maximum current $I_{MAX}$ considering them is represented by Equation 5.

$$\frac{100}{\alpha} \times \frac{GV}{2^n - 1} \times I_{MAX} = \frac{1}{2}\mu C_{ox}\frac{W}{L}(V_{dd} - V_G - |V_{th}|)^2 \quad \text{[Equation 5]}$$

Here, GV is a gray value.

Here, the gray value GV is an integer from 0 to $2^{n-1}$, n is a bit number of an input image signal, and the gray value GV is a value from 0 to 255 if the bit number n of the input image signal is 8. α is a value representing the degradation degree of the organic light emitting element OLED, and the value may be output from the lookup table stored in the memory 700 according to the voltage sensed by measuring the degradation of the organic light emitting element OLED.

Equation 5 may be summarized with reference to $V_G$ as Equation 6.

$$V_G = V_{dd} - |V_{th}| - \sqrt{\frac{100}{\alpha}} \times \sqrt{\frac{GV}{2^n - 1}} \times \sqrt{\frac{2I_{MAX} \times L}{\mu C_{ox} \times W}} \quad \text{[Equation 6]}$$

Here, GV is the gray value.

Equation 1 and Equation 4 may be reflected to Equation 5 as Equation 7.

$$V_G = V_N - \sqrt{\frac{100}{\alpha}} \times \sqrt{\frac{\text{data}}{2^n - 1}}(V_N - V_{GMAX}) \quad \text{[Equation 7]}$$

Here, $V_N$, $V_{GMAX}$, and α are values stored to the memory through the measuring of the threshold voltage Vth of the driving transistor Qd, the mobility μ, and the degradation of the OLED. Therefore, $V_G$ may be obtained according to the gray value GV of the input data, and the data voltages are generated according to the $V_G$ values to apply them to the data lines. As a result, the input data is amended and applied to the pixel PX based on the characteristic of each pixel PX of the display device and thereby the quality of the display is improved, and the characteristic difference between the pixels PX is removed.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a data driver;

a plurality of data lines and a plurality of sensing lines connected to the data driver; and a pixel connected to each data line and sensing line, the pixel to display images, wherein the pixel comprises:

a light-emitting element comprising a first terminal and a second terminal, a driving transistor comprising a control terminal, an input terminal, and an output terminal, the driving transistor to output a driving current to drive the light-emitting element, a first switching transistor controlled by a first scanning signal, and connected between the respective data line and the control terminal of the driving transistor;

a second switching transistor controlled by a second scanning signal, and connected between the respective sensing line and the output terminal of the driving transistor;

a third switching transistor controlled by a third scanning signal, and connected between the output terminal of the driving transistor and the first terminal of the light-emitting element;

a fourth switching transistor controlled by a fourth scanning signal, and connected between the control terminal of the driving transistor and the respective sensing line; and a capacitor connected between the control terminal of the driving transistor and a driving voltage terminal.

2. The display device of claim 1, wherein the data driver determines at least one of a threshold voltage of the driving transistor, a mobility of the driving transistor, and a degradation of the light-emitting element.

3. The display device of claim 2, wherein the data driver comprises a threshold voltage sensor to determine the threshold voltage of the driving transistor.

4. The display device of claim 3, wherein the threshold voltage sensor comprises a ground terminal or a voltage application terminal with a lower voltage than the driving voltage, and a switch to control on/off of the respective sensing line.

5. The display device of claim 4, wherein the threshold voltage sensor detects the threshold voltage through the voltage of the control terminal of the driving transistor after the switch is turned on and off during a time in a state in which the first scanning signal and the third scanning signal are applied with an off voltage, and the second scanning signal and the fourth scanning signal are applied with an on voltage.

6. The display device of claim 2, wherein the data driver comprises a mobility sensor to determine the mobility of the driving transistor.

7. The display device of claim 6, wherein the mobility sensor comprises a current source to apply the same current as a maximum current that is applied to the driving transistor and a switch to turn on/off the current and the respective sensing line.

8. The display device of claim 7, wherein the mobility sensor determines the mobility of the driving transistor through the voltage of the control terminal of the driving transistor, which is measured by turning on the switch in a state in which the first scanning signal and the third scanning signal are applied with the off voltage, and the second scanning signal and the fourth scanning signal are applied with the on voltage.

9. The display device of claim 2, wherein the data driver comprises a degradation sensor to determine the degradation of the light-emitting element.

10. The display device of claim 9, wherein the degradation sensor comprises at least two current sources and at least two switches to turn on/off the at least two current sources and the sensing line.

11. The display device of claim 10, wherein the degradation sensor determines the voltage of the output terminal of the driving transistor, and determines the degradation degree of the light-emitting element by using at least two measured voltages in a state in which the at least two switches are sequentially turned on, and the switches are turned on.

12. The display device of claim 2, further comprising a fifth switching transistor controlled by a fifth scanning signal, and connected between the first terminal of the light-emitting element and the respective sensing line.

13. The display device of claim 12, wherein the degradation degree of the light-emitting element is determined through the voltage of the first terminal of the light-emitting element in a state in which the first scanning signal, the second scanning signal, and the fourth scanning signal are applied with the off voltage, and the third scanning signal and the fifth scanning signal are applied with the on voltage.

14. The display device of claim 12, wherein the second scanning signal and the fourth scanning signal are the same signal.

15. The display device of claim 12, wherein:

the data driver comprises a threshold voltage sensor to measure the threshold voltage of the driving transistor, and a mobility sensor to measure the mobility of the driving transistor;

the threshold voltage sensor comprises a ground terminal and a first switch to control on/off of the sensing line; and the mobility sensor comprises a current source to apply the same current as a maximum current that is applied to the driving transistor, and a second switch to turn the current source and the sensing line on and off.

16. The display device of claim 15, wherein:

the data driver further comprises a degradation sensor to determine the degradation of the light-emitting element; and the degradation sensor comprises at least two current sources and at least two switches to turn on/off the at least two current sources and the sensing lines.

17. A method for driving a display device having a display panel comprising a pixel comprising a light-emitting element comprising a first terminal and a second terminal, a driving transistor to output a driving current to drive the light-emitting element and comprising a control terminal, an input terminal, and an output terminal, a first switching transistor controlled by a first scanning signal and connected between a data line and the control terminal of the driving transistor, a second switching transistor controlled by a second scanning signal and connected between a sensing line and the output terminal of the driving transistor, a third switching transistor controlled by a third scanning signal and connected between the output terminal of the driving transistor and the first terminal of the light-emitting element, a fourth switching transistor controlled by a fourth scanning signal and connected between the control terminal of the driving transistor and the sensing line, and a capacitor connected between the control terminal of the driving transistor and a terminal of a driving voltage, a plurality of data lines and a plurality of sensing lines connected to the pixel, and a data driver connected to the data lines and the sensing lines, the method comprising:

is executing at least one of determining a threshold voltage of the driving transistor, determining a mobility of the driving transistor, and determining a degradation of the light-emitting element; and amending and converting input data into a data voltage based on the determined result to apply the data voltage to the pixel according to the respective data line.

18. The method of claim 17, wherein all of the determining of the threshold voltage of the driving transistor, the determining of the mobility of the driving transistor, and the determining of the degradation of the light-emitting element are executed in a turn-on interval after turning on the display device before displaying images of the pixel.

19. The method of claim 17, wherein:

the determining of the threshold voltage of the driving transistor and the determining of the mobility of the driving transistor are executed in a turn-on interval after turning on the display device before displaying images of the pixel; and the determining of the degradation of the light-emitting element is executed in an emission interval in which the light-emitting element emits light.

20. The method of claim 17, wherein:

the determining of the degradation of the light-emitting element is executed in an emission interval in which the light-emitting element emits light; and the determining of the threshold voltage and the determining of the mobility are executed in a black interval in which the light-emitting element displays black between the emission intervals.

* * * * *